US006552289B2

(12) United States Patent
Kawaguchi et al.

(10) Patent No.: US 6,552,289 B2
(45) Date of Patent: Apr. 22, 2003

(54) DOME SWITCH

(75) Inventors: Kenichiro Kawaguchi, Shizuoka (JP); Yasuyoshi Serizawa, Shizuoka (JP); Minoru Kubota, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/995,840

(22) Filed: Nov. 29, 2001

(65) Prior Publication Data

US 2002/0079209 A1 Jun. 27, 2002

(51) Int. Cl.[7] ..... H01H 1/10

(52) U.S. Cl. ..... 200/512; 200/5 A; 200/5 R; 200/17 A

(58) Field of Search ..... 200/5 A, 512, 200/513–516, 293.1, 302.2, 341, 342, 344, 85 R, 5 R, 17 R, 18

(56) References Cited

U.S. PATENT DOCUMENTS

| | | | | | |
|---|---|---|---|---|---|
| 4,598,181 | A | * | 7/1986 | Selby | 200/5 A |
| 4,916,275 | A | * | 4/1990 | Almond | 200/516 |
| 5,828,016 | A | * | 10/1998 | Grannan et al. | 200/16 R |
| 6,073,341 | A | * | 6/2000 | Odorfer | 29/622 |
| 6,084,189 | A | * | 7/2000 | Menche et al. | 200/315 |

* cited by examiner

*Primary Examiner*—Lincoln Donovan
*Assistant Examiner*—Kyung Lee
(74) *Attorney, Agent, or Firm*—Sughrue Mion, PLLC

(57) ABSTRACT

In a dome switch (21) including a surface sheet (22), a spacer sheet (23), an FPC (24) serving as a circuit member, and an adhesive sheet (25), an accommodating portion (34) for a chip component (38) mounted on a contact (37) side of the FPC (24) is formed in the spacer sheet (23). In addition, an embossed portion (28) for the chip component (38) is formed in the surface sheet (22), as required.

19 Claims, 14 Drawing Sheets

PRIOR ART

PRIOR ART

DOME SWITCH

BACKGROUND OF THE INVENTION

The present invention relates to a dome switch including a surface sheet having a dome-shaped protuberance, a spacer sheet, the circuit member, and an adhesive sheet.

FIG. 15 is an exploded perspective view of a poly-dome switch (dome switch) in a related art, FIG. 16 is a cross-sectional view of essential portions before the switching operation, and FIG. 17 is a cross-sectional view of the essential portions at the time of the switching operation.

In FIG. 15, a related poly-dome switch (dome switch) 1 used in a household electric appliance includes a surface sheet 2, a spacer sheet 3, a flexible printed circuit (FPC) 4, and an adhesive sheet 5, and is fixed to a plate 6 serving as an attaching member to be attached to with the adhesive sheet 5 interposed.

A plurality of dome-shaped protuberances 7 which project toward the outer surface side and are capable of being reversed toward the inner surface side are formed in the aforementioned surface sheet 2. Electrodes 8 (see FIG. 16) for the FPC 4 are respectively provided on the inner surfaces of the protuberances 7.

The spacer sheet 3 is a thin sheet member and is provided to prevent the deformation of the surface sheet 2. The spacer sheet 3 is provided with adhesive layers on its obverse and reverse surfaces, so that the surface sheet 2 and the FPC 4 can be fixed thereto. A plurality of through holes 9 are formed in the spacer sheet 3 in such a manner as to correspond to the positions of the protuberances 7. Further, slit-like air release portions 10 are respectively formed on both sides of the through holes 9.

The FPC 4 is a circuit member having a plurality of circuits routed in desired patterns. A plurality of contacts 11 which are contacted by the electrodes 8 (see FIG. 16) are provided on its spacer sheet 3 side. The FPC 4 is bonded and fixed to the adhesive sheet 5. The adhesive sheet 5 has the function as a reinforcing member.

In the above-described construction, the poly-dome switch 1 operates such that, as shown in FIG. 17, when the protuberance 7 is pressed down to effect a switching operation, the protuberance 7 is reversed toward the FPC 4 (the feeling of a click occurs at this time), and the electrode 8 is brought into contact with the contact 11 to energize the circuit. It should be noted that when the protuberance 7 is reversed toward the FPC 4, the air located on the inner surface side of the protuberance 7 is vented to the air release portions 10 through the through hole 9.

In the above-described poly-dome switch 1, the structure provided is such that the spacer sheet 3 and the FPC 4 are brought into surface contact with each other. For this reason, there has been a problem in that when an attempt is made to mount chip components on the FPC 4 and assemble them, the spacer sheet 3 is lifted off the FPC 4 and becomes deformed due to the effect of the height of the chip components. Incidentally, if the spacer sheet 3 is lifted off and becomes deformed, the switching function is naturally affected.

SUMMARY OF THE INVENTION

The invention has been devised in view of the above-described circumstances, and its object is to provide a chip-component accommodating structure in a dome switch which makes it possible to mount a chip component on a circuit member.

In order to solve the aforesaid object, the invention is characterized by having the following arrangement.

(1) A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

an adhesive sheet including on one side a circuit attaching surface for the circuit member and on the other side a bonding and fixing surface for an attaching member; and a spacer sheet-side accommodating portion, for accommodating a chip component mounted on a side of the circuit member where the contact is disposed, formed in the spacer sheet.

(2) The dome switch according to (1), wherein an embossed portion for the chip component is formed in the surface sheet in correspondence with a position of the spacer sheet-side accommodating portion.

(3) A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

an adhesive sheet including on one side a circuit attaching surface for the circuit member and on the other side a bonding and fixing surface for an attaching member; and an adhesive sheet-side accommodating portion, for accommodating a chip component mounted on a side of the circuit member where the contact is not disposed, formed in the adhesive sheet.

(4) The dome switch according to (3), wherein a recessed portion for the chip component is formed in the attaching member in correspondence with a position of said adhesive sheet-side accommodating portion.

(5) A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

an adhesive sheet including on one side a circuit attaching surface for the circuit member and on the other side a bonding and fixing surface for an attaching member;

a spacer sheet-side accommodating portion, for accommodating a chip component mounted on a side of the circuit member where the contact is disposed, is formed in the spacer sheet; and an adhesive sheet-side accommodating portion, for accommodating a chip component mounted on a side of the circuit member opposite to the side where the contact is disposed, is formed in the adhesive sheet.

(6) The dome switch according to (5), wherein an embossed portion for the chip component is formed in the surface sheet in correspondence with a position of the spacer sheet-side accommodating portion.

(7) The dome switch according to (5), wherein a recessed portion for the chip component is formed in the attaching member in correspondence with a position of the adhesive sheet-side accommodating portion.

(8) A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

a light guiding portion, for accommodating and light guidance for a LED mounted on a side of the circuit member where the contact is disposed, formed in the spacer sheet; and a light emitting portion, which is illuminated by light from the LED and through which the light can pass, formed in the surface sheet.

(9) The dome switch according to (8), wherein a light diffusing member for diffusing the light from the LED toward the light emitting portion is formed between the light guiding portion and the light emitting portion.

(10) The dome switch according to (8), further comprising:

an adhesive sheet having on one side a circuit attaching surface for the circuit member and on the other side a bonding and fixing surface for an attaching member; and an external connection member provided on the circuit member so as to be used for electrical connection to an external circuit.

(11) The dome switch according to (10), wherein the external connection member includes edge connector terminals or a connector.

(12) The dome switch according to (11), wherein the external connection member includes a connection circuit portion led out from a circuit member body.

(13) The dome switch according to (10), wherein the adhesive sheet includes a release paper on the bonding and fixing surface.

(14) A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

a light guiding portion, for accommodating and light guidance for a LED mounted on a side of the circuit member where the contact is disposed, formed in the spacer sheet;

a light collecting portion, for collecting the light guided by the light guiding portion, formed in the spacer sheet; and a light emitting portion, which is illuminated by collected light from the light collecting portion and through which the light can pass, formed in the surface sheet.

(15) The dome switch according to (14), wherein a reflector is provided on obverse and reverse surfaces of the spacer sheet or on the inner surface of the surface sheet and the side of the circuit member where the contact is disposed.

(16) The dome switch according to (14), further comprising:

an adhesive sheet having on one side a circuit attaching surface for the circuit member and on the other side a bonding and fixing surface for an attaching member; and an external connection member provided on the circuit member so as to be used for electrical connection to an external circuit.

(17) The dome switch according to (16), wherein the external connection member includes edge connector terminals or a connector.

(18) The dome switch according to (179, wherein the external connection member includes a connection circuit portion led out from a circuit member body.

(19) The dome switch according to (16), wherein the adhesive sheet includes a release paper on the bonding and fixing surface.

In accordance with the intention, in the assembly of the dome switch, the chip component mounted on the contact side of the circuit member is accommodated in the spacer sheet-side accommodating portion of the spacer sheet. By forming the spacer sheet-side accommodating portion in the spacer sheet, it becomes possible to mount the chip component on the contact side of the circuit member.

In accordance with the invention, in the assembly of the dome switch, the chip component mounted on a side of the circuit member opposite to its side where the contact is formed is accommodated in the adhesive sheet-side accommodating portion of the adhesive sheet. By forming the adhesive sheet-side accommodating portion in the adhesive sheet, it becomes possible to mount the chip component on the side of the circuit member opposite to the side where the contact is disposed.

In accordance with the invention, in the assembly of the dome switch, the chip component mounted on the contact side of the circuit member is accommodated in the spacer sheet-side accommodating portion of the spacer sheet. In addition, the chip component mounted on a side of the circuit member opposite to its side where the contact is formed is accommodated in the adhesive sheet-side accommodating portion of the adhesive sheet. By forming the spacer sheet-side accommodating portion in the spacer sheet, it becomes possible to mount the chip component on the contact side of the circuit member. Further, by forming the adhesive sheet-side accommodating portion in the adhesive sheet, it becomes possible to mount the chip component on the side of the circuit member opposite to the side where the contact is disposed.

In accordance with the invention, in a case where the height of the chip component mounted on the contact side of the circuit member is large, a tip portion of the chip portion is accommodated in the embossed portion of the surface sheet. By forming the embossed portion in the surface sheet, it becomes possible to mount the chip component with large height on the contact side of the circuit member.

In accordance with the invention, in a case where the height of the chip component mounted on the side of the circuit member opposite to the side where the contact is disposed is large, a tip portion of the chip portion is accommodated in the recessed portion of the attaching member. By forming the recessed portion in the attaching member, it becomes possible to mount the chip component with large height on the side of the circuit member opposite to the side where the contact is disposed.

In accordance with the invention, in the poly-dome switch, the LED is mounted on the circuit member. If the LED is made to emit light, the light from the LED is guided through the light guiding portion in the spacer sheet, and the light emitting portion of the surface sheet is illuminated. Further, the light emitting portion, as it were, emits light due to the light which passed through the light emitting portion. Meanwhile, in the assembly of the dome switch, the LED mounted on the circuit member is accommodated in the light guiding portion of the spacer sheet. By forming the light guiding portion in the spacer sheet, it becomes possible to mount the LED on the contact side of the circuit member.

In accordance with the invention, if the LED is made to emit light, the light emitting portion of the surface sheet is illuminate by the diffused light. Consequently, the light emitting portion is prevented from becoming partially bright.

In accordance with the invention, in the poly-dome switch, the LED is mounted on the circuit member. If the LED is made to emit light, the light from the LED is guided through the second light guiding portion and the light collecting portion in the spacer sheet, and the second light emitting portion of the surface sheet is illuminated. Further, the second light emitting portion, as it were, emits light due to the light which passed through the second light emitting portion. Meanwhile, in the assembly of the dome switch, the LED mounted on the circuit member is accommodated in the second light guiding portion of the spacer sheet. By forming the second light guiding portion in the spacer sheet, it becomes possible to mount the LED on the contact side of the circuit member.

In accordance with the invention, the light is efficiently guided between the second light guiding portion and the light collecting portion by the reflector.

In accordance with the invention, the adhesive sheet is further provided in the arrangement, and since the circuit member has the external connection member, the dome switch can be installed at a position which meets the user's need. In addition, fixation is effected by merely attaching the bonding and fixing surface to the attaching member, so that the dome switch can be easily installed.

In accordance with the invention, electrical connection to an external circuit is effected by the edge connector terminals or the connector.

In accordance with the invention, electrical connection to an external circuit is made within the range of the length of the connection circuit portion led out from the circuit member body In accordance with the invention, the bonding and fixing surface is protected up until the time of final use. In addition, the switch can be carried in a state in which the release paper is provided on the bonding and fixing surface.

DETAILED DESCRIPTION OF PREFERRED EMBODIMENTS

Referring now to the accompanying drawings, a description will be given of an embodiment of the invention.

First Embodiment

Figure 1:
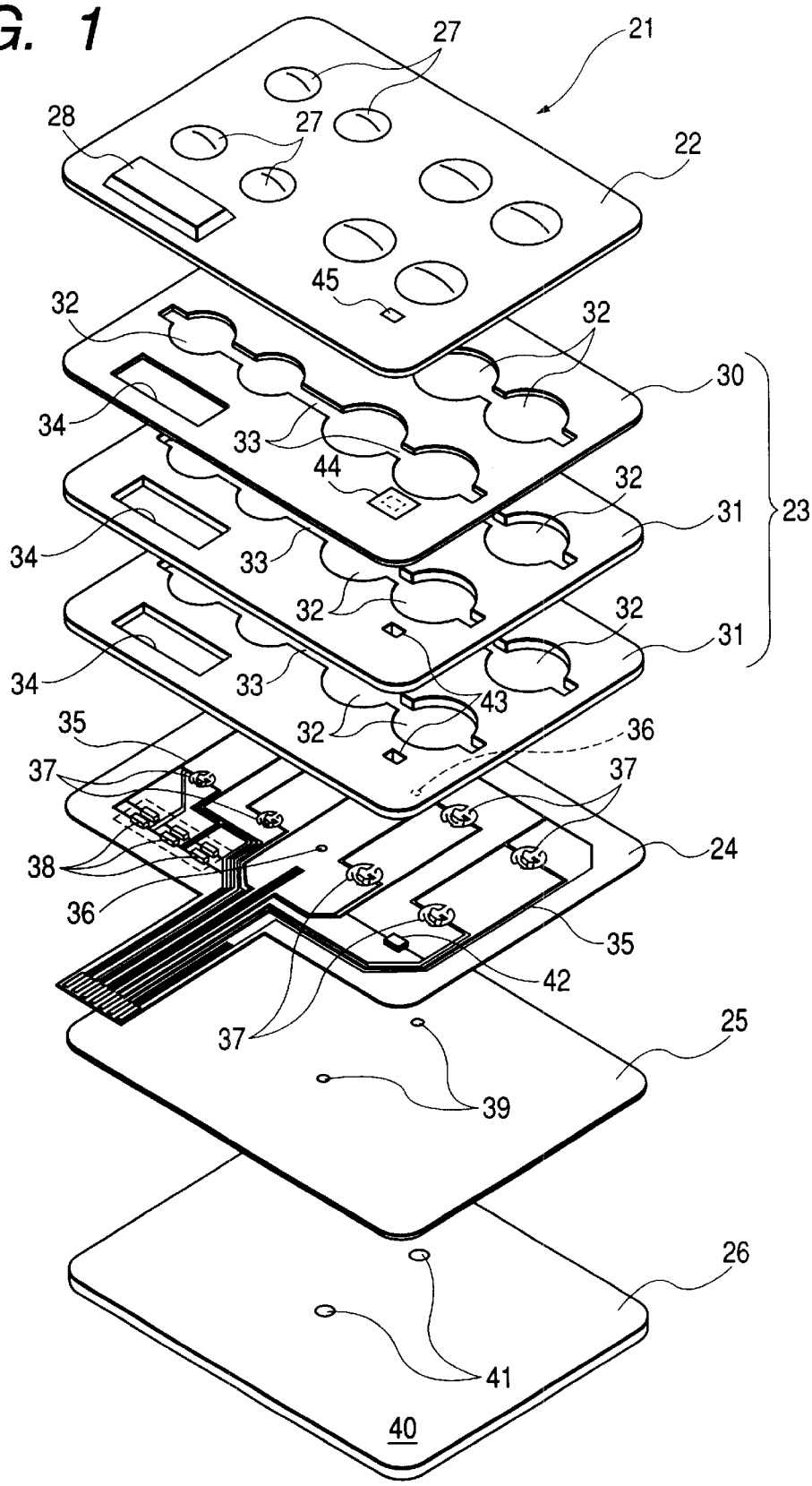
FIG. 1 is an exploded perspective view illustrating a first embodiment of a chip-component accommodating structure in a dome switch in accordance with the invention.
Figure 2:
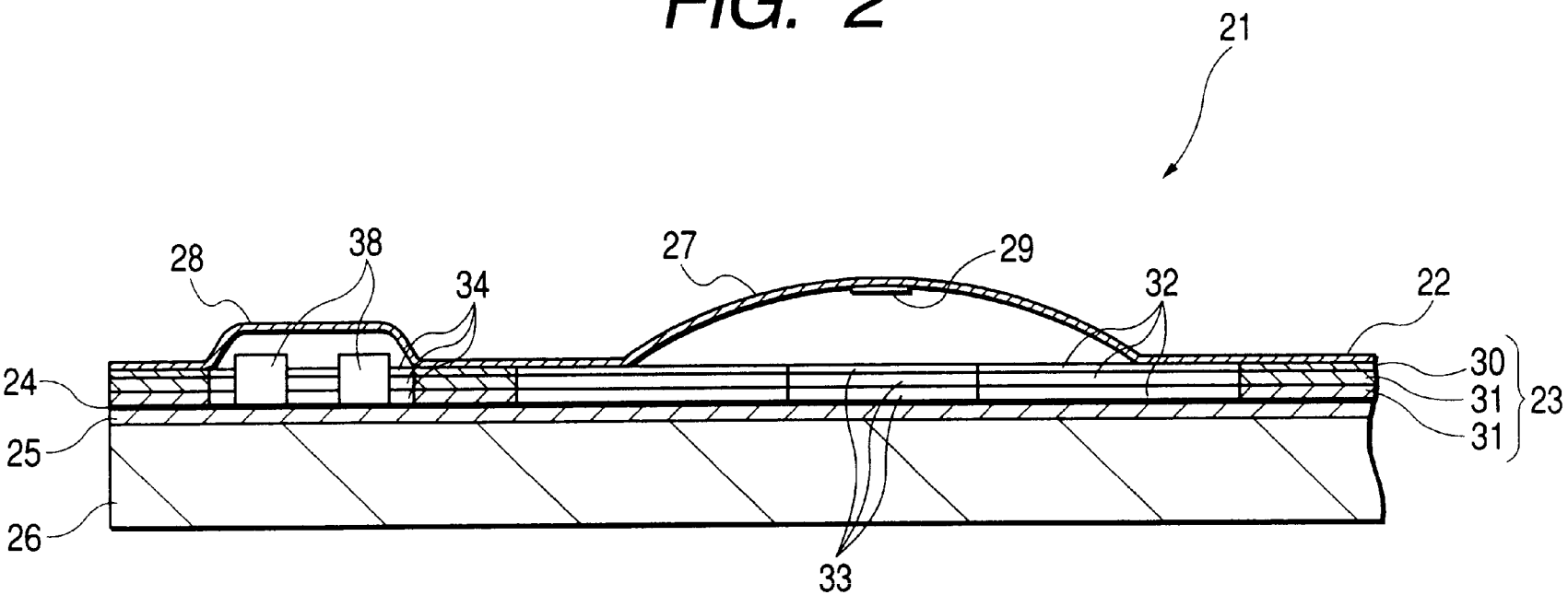
FIG. 2 is an enlarged cross-sectional view of a chip-component accommodating portion shown in FIG. 1.

FIG. 1 is an exploded perspective view illustrating a first embodiment of a chip-component accommodating structure in a dome switch in accordance with the invention. FIG. 2 is an enlarged cross-sectional view of a chip-component accommodating portion shown in FIG. 1.

In FIG. 1, a poly-dome switch 21 (corresponding to the dome switch in the claims) is constituted by a surface sheet 22, a spacer sheet 23, a flexible printed circuit (FPC) 24, and an adhesive sheet 25. The poly-dome switch 21 is fixed to a plate 26 serving as an example of an attaching member to be attached to by the adhesive sheet 25. In the first embodiment of the invention, the chip-component accommodating structure is formed in the surface sheet 22 and the spacer sheet 23.

The surface sheet 22 includes a plurality of protuberances 27 and an embossed portion 28 constituting the aforementioned chip-component accommodating structure. Each of protuberances 27 is formed in a dome shape so as to project toward outside and is capable of being reversed toward inside. An electrode 29 (see FIG. 2) for the FPC 24 is provided on the inner surface of each protuberance 27. The electrode 29 is provided on a top portion of the inner surface.

The embossed portion 28 is formed in the shape of a rectangular dome (it should be construed that the shape is not limited to this shape) projecting toward the outer surface side in the same way as the protuberance 27. The embossed portion. 28 is formed in correspondence with the mounting position of chip components 38 which will be described later. The embossed portion 28 is formed in such a manner as to be capable of accommodating tips of the chip components 38, as will be described later. It should be noted that the embossed portion 28 need not be capable of being reversed like the protuberance 27.

The surface sheet 22 will be described in detail. The surface sheet 22 is a synthetic resin-made sheet formed of polyethylene terephthalate (PET), for example, and includes the plurality of dome-shaped protuberances 27 and the rectangular dome-shaped embossed portion 28 which are formed by being subjected to heat pressing (by applying pressure from the inner surface side toward the outer surface side) The electrodes 29 provided on top portions of the inner surfaces of the protuberances 27 are formed of carbon or the like (the electrodes 29 formed of carbon are provided by printing).

The spacer sheet 23 is constituted by an upper-layer spacer sheet 30 and two lower-layer spacer sheets 31. Namely, the spacer sheet 23 is constituted by three layers (the spacer sheet 23 need not necessarily be formed in three layers, and may be formed in a single layer, two layers, or four or more layers; if the spacer sheet 23 is formed in a plurality of layers, there is an advantage that the spacer sheet can be provided with more flexibility than in the case of a single layer). The spacer sheet 23 is adapted to function as a member for preventing the deformation of the surface sheet 22.

The upper-layer spacer sheet 30 is a synthetic resin-made sheet formed of polyethylene terephthalate (PET), for example, and the upper-layer spacer sheet 30 is formed to be thinner than the lower-layer spacer sheets 31. Namely, the upper-layer spacer sheet 30 functions as a fine-adjustment sheet member for adjusting the thickness of the spacer sheet 23. In addition, the upper-layer spacer sheet 30 has layers of an unillustrated adhesive agent on its obverse and reverse surfaces, so that the surface sheet 22 and the lower-layer spacer sheet 31 can be fixed to its obverse and reverse surfaces, respectively.

The upper-layer spacer sheet 30 will be described in detail. The upper-layer spacer sheet 30 has a plurality of through holes 32, a plurality of air release portions 33, and an accommodating portion 34 (corresponding to a spacer sheet-side accommodating portion stated in the claims) constituting the aforementioned chip-component accommodating structure. Each through hole 32 is a portion for ensuring contact between the electrode 29 of the protuberance 27 and a contact 37 (which will be described later) of the FPC 24, and is formed in conformity with the position of the corresponding protuberance 27. Each through hole 32 is formed to have a diameter greater than or equal to the diameter of the protuberance 27 (see FIG. 2).

Each of the air release portions 33 is a portion which allows the air located on the inner surface side to be released appropriately when each protuberance 27 is reversed. The air release Portions 33 are formed between adjacent ones of the through holes 32 arranged in the longitudinal direction in the upper-layer spacer sheet 30. Each of the air release portions 33 is formed in the shape of a slit in such a manner as to communicate with the corresponding through holes 32.

The accommodating portion 34 is formed in a rectangular shape in correspondence with the mounting position of the chip components 38, as will be described later.

Each of the lower-layer spacer sheets 31 is a synthetic resin-made sheet formed of polyethylene terephthalate (PET), for example, and includes unillustrated adhesive layers on its obverse and reverse surfaces, so that after their lamination the upper-layer spacer sheet 30 and the FPC 24 can be fixed to the obverse and reverse surfaces, respectively. The lower-layer spacer sheets 31 includes the through holes 32, the air release portions 33, and the accommodating portion 34 provided in the same numbers and having the same shapes, positions, and function as those of the upper-layer spacer sheet 30. Incidentally, these members will be denoted by the same reference numerals as those of the upper-layer spacer sheet 30, and a description thereof will be omitted. It should be noted that the diameter of each through hole 32 in each lower-layer spacer sheet 31 is formed to be greater than or equal to the diameter of each through hole 32 in the upper-layer spacer sheet 30. It goes without saying that if the diameter of each through hole 32 in each spacer sheet 31 becomes large, the space concerning the venting of air can be made large, and the feeling of a click at the time of the switching operation improves.

The aforementioned FPC 24 is a circuit member including a plurality of circuits 35 routed in desired patterns, and two air vents 36 communicating with the air release portions 33 in the respective layers of the spacer sheet 23 are formed in its central portion. The plurality of contacts 37 with which the electrodes 29 (see FIG. 2) are brought into contact are disposed on the spacer sheet 23 side of the FPC 24. The plurality of chip components 38 are mounted on the spacer sheet 23 side (contact 37 side) of the FPC 24. Incidentally, the circuit member is not confined to the FPC (FPC 24)

The adhesive sheet 25 is formed so as to be able to bond and fix the FPC 24. The adhesive sheet 25 is formed so as to be bonded and fixed to the plate 26. Namely, the adhesive sheet 25 includes on one side a circuit attaching surface for the FPC 24 and on its other side a bonding and fixing surface for the plate 26. The adhesive sheet 25 functions as a reinforcing member. Two air vents 39 communicating with the air vents 36 in the FPC 24 and similar thereto are formed in the adhesive sheet 25.

The plate 26 includes an attaching surface 40 to which the bonding and fixing surface of the adhesive sheet 25 adheres. Two space portions 41 having, for example, U-shaped cross sections are arranged and formed in the attaching surface 40. The space portions 41 are communicated with the air release portions 33 in the spacer sheet 23 through the air vents 36 in the FPC 24 and the air vents 39 in the adhesive sheet 25 (the air vents 36 in the FPC 24 and the air vents 39 in the adhesive sheet 25 function as passages for communication with the air release portions 33 in the spacer sheet 23 and the space portions 41 in the plate 26). It should be noted that the plate 26 in terms of its shape may be formed in the shape of a housing like a switch casing.

Reference numeral 42 denotes a light emitting diode (LED) mounted on the spacer sheet 23 side (contact 37 side) of the FPC 24. Reference numeral 43 in each of the lower-layer spacer sheets 31 denotes a light guiding portion for the LED 42. Each of the light guiding portions 43 is formed so as to have an accommodating structure (application of the invention) for the LED 42. Reference numeral 44 in the upper-layer spacer sheet 30 denotes a diffusing means 44 for diffusing the light from the LED 42. Reference numeral 45 in the surface sheet 22 denotes a light emitting portion which is illuminated by the light from the LED 42 and where the light passes.

In the above-described construction, the poly-dome switch 21 is assembled as follows: First, the upper-layer spacer sheet 30 and the lower-layer spacer sheets 31 are bonded and fixed together to form the spacer sheet 23. Next, the surface sheet 22 is bonded and fixed to the surface (actually, the upper-layer spacer sheet 30) of the spacer sheet 23, and the FPC 24 is bonded and fixed to the revere surface (actually, the lowermost lower-layer spacer sheet 31) of the spacer sheet 23, so that the plurality of chip components 38.mounted on the spacer sheet 23 side (contact 37 side) of the FPC 24 are accommodated in the accommodating portions 34 of the upper-layer spacer sheet 30 and the lower-layer spacer sheets 31 (see FIG. 2). Subsequently, the FPC 24 side of this subassembly is bonded and fixed to the circuit attaching surface of the adhesive sheet 25, thereby completing the assembly. It should be noted that the assembled poly-dome switch 21 is mounted by causing the bonding and fixing surface of the adhesive sheet 25 to adhere to the attaching surface 40 of the plate 26.

As described above, the poly-dome switch 21 in accordance with the first embodiment has the chip-component accommodating structure which allows the plurality of chip components 38 mounted on the'spacer sheet 23 side (contact 37 side) of the FPC 24 to be accommodated in the accommodating portions 34 of the upper-layer spacer sheet 30 and the lower-layer spacer sheets 31 and in the embossed portion 28 of the surface sheet 22. Consequently, even if the chip components 38 are mounted on the FPC 24, the spacer sheet 23 is prevented from becoming lifted off the FPC 24 and deformed. Accordingly, even if the chip components 38 are mounted on the FPC 24, the switching function is not affected.

Second Embodiment

Figure 3:
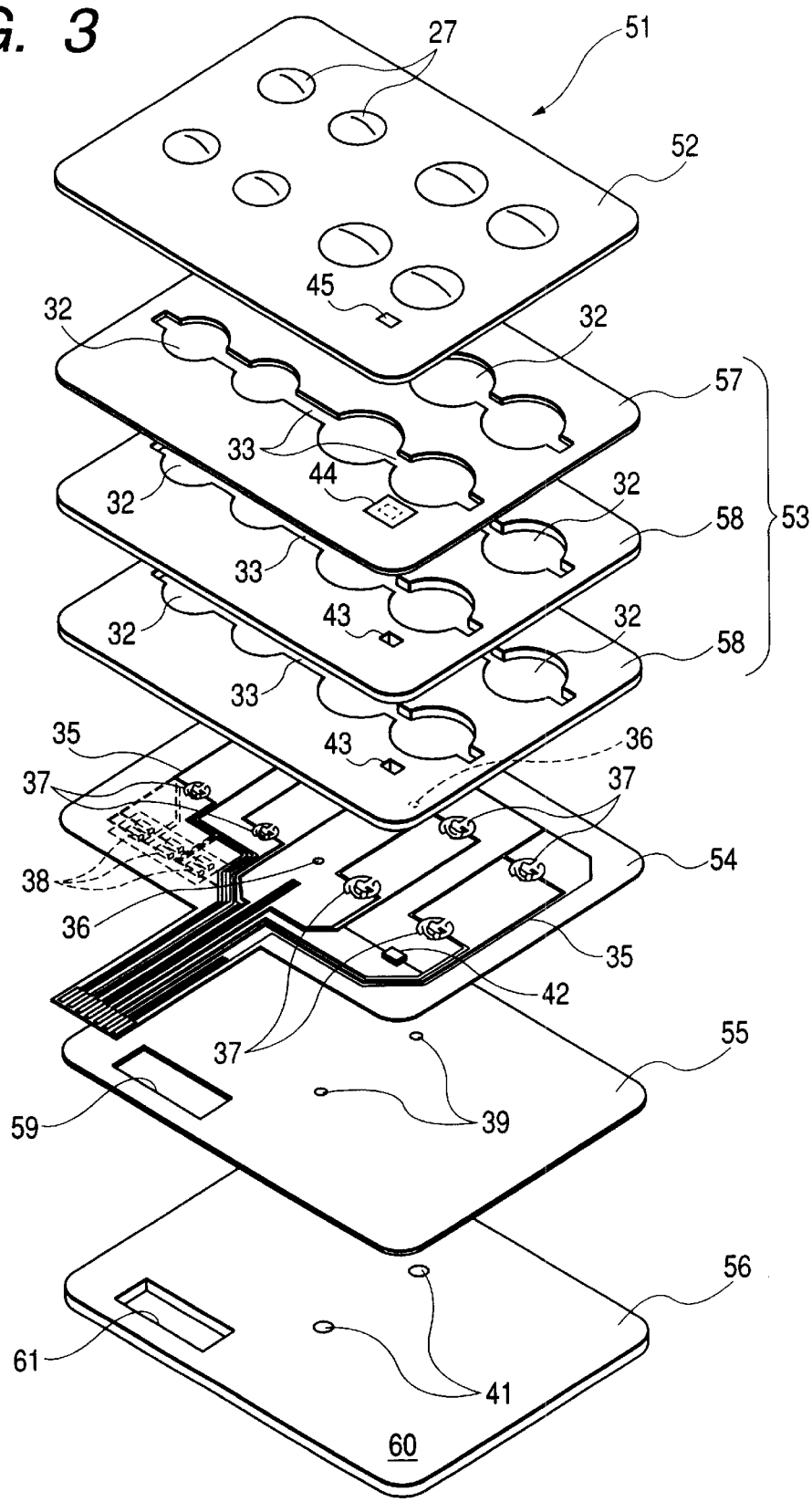
FIG. 3 is an exploded perspective view illustrating a second embodiment of the chip-component accommodating structure in a dome switch in accordance with the invention.

Next, referring to FIG. 3, a description will be given of the chip-component accommodating structure in a done switch in accordance with a second embodiment. FIG. 3 is an exploded perspective view illustrating the second embodiment of the chip-component accommodating structure in a dome switch. It should be noted that portions which are basically identical to the portions of the above-described component members will be denoted by the same reference numerals, and a description thereof will be omitted.

In FIG. 3, a poly-dome switch 51 (corresponding to the dome switch stated in the claims) is constituted by a surface sheet 52, a spacer sheet 53, a flexible printed circuit (FPC) 54, and an adhesive sheet 55. The poly-dome switch 51 is fixed to a plate 56 serving as, for example, the attaching member to be attached to by the adhesive sheet 55. In the second embodiment of the invention, the chip-component accommodating structure is formed in the adhesive sheet 55 and the plate 56.

Figure 4:
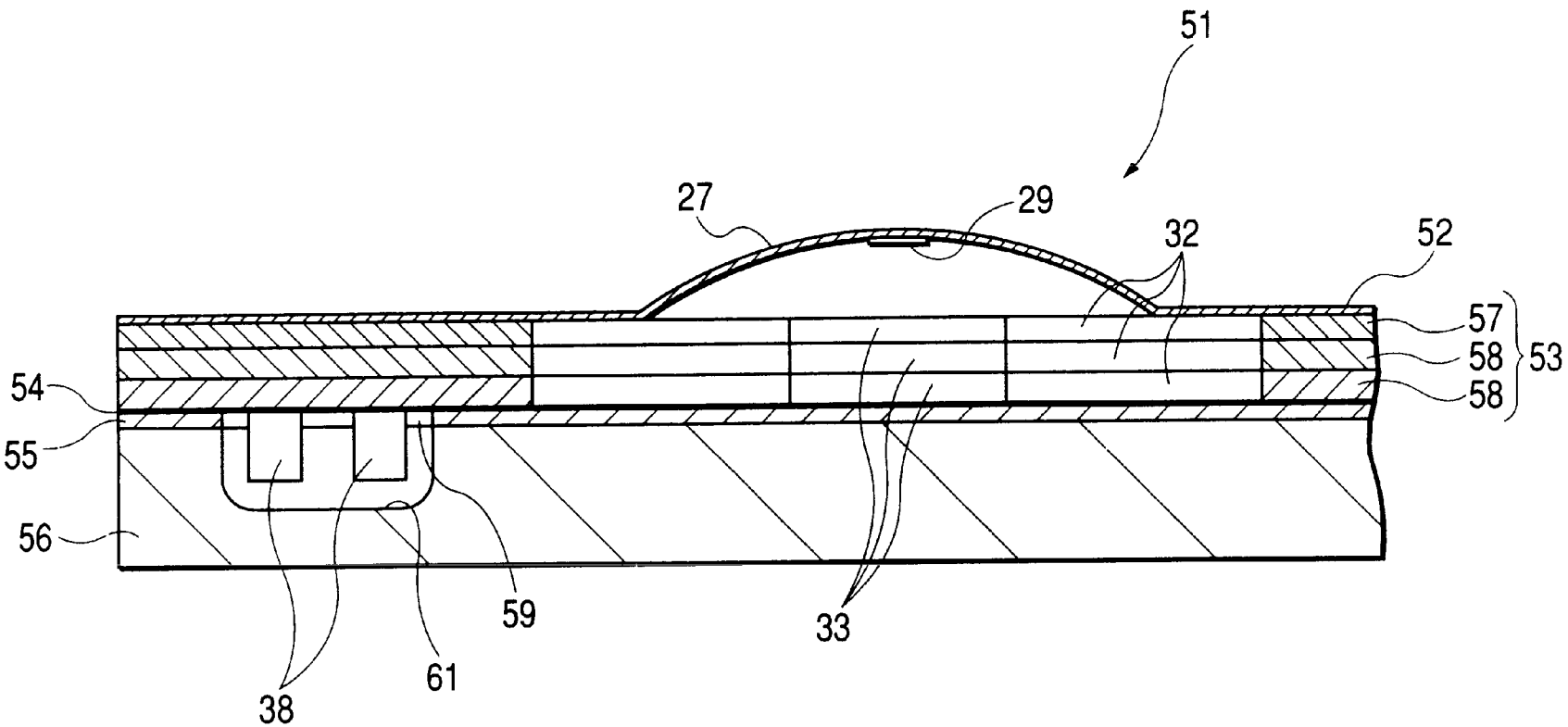
FIG. 4 is an enlarged cross-sectional view of the chip-component accommodating portion shown in FIG. 3.

The surface sheet 52 is a synthetic resin-made sheet formed of polyethylene terephthalate (PET), for example, and includes the plurality of protuberances 27. The electrodes 29 (see FIG. 4) for the FPC 54 are provided on the inner surfaces of the protuberances 27. The electrodes 29 (see FIG. 2) are provided on top portions of the inner surfaces.

The spacer sheet 53 comprises an upper-layer spacer sheet 57 and two lower-layer spacer sheets 58. Namely, the spacer sheet 53 is formed in three layers (in the same way as the aforementioned spacer sheet 23 the spacer sheet 53 need not necessarily be formed in three layers, and may be formed in a single layer, two layers, or four or more layers). In addition, the spacer sheet 53 is adapted to function as a member for preventing the deformation of the surface sheet 52.

The upper-layer spacer sheet 57 is a synthetic resin-made sheet formed of polyethylene terephthalate (PET), for example, and the upper-layer spacer sheet 57 is formed to be thinner than the lower-layer spacer sheets 58. Namely, the upper-layer spacer sheet 57 functions as a fine-adjustment sheet member for adjusting the thickness of the spacer sheet 53. The upper-layer spacer sheet 57 has layers of an unillustrated adhesive agent on its obverse and reverse surfaces, so that the surface sheet 52 and the lower-layer spacer sheet 58 can be fixed to its obverse and reverse surfaces, respectively. The upper-layer spacer sheet 53 includes the plurality of through holes 32 and the plurality of air release portions 33.

Each of lower-layer spacer sheets 58 is a synthetic resin-made sheet formed of polyethylene terephthalate (PET), for example, and includes unillustrated adhesive layers on its obverse and reverse surfaces, so that after their lamination the upper-layer spacer sheet 57 and the FPC 54 can be fixed to the obverse and reverse surfaces, respectively. The lower-layer spacer sheets 58 include the through holes 32 and the air release portions 33 provided in the same numbers and having the same shapes, positions, and functions as those of the upper-layer spacer sheet 57. Incidentally, these members will be denoted by the same reference numerals as those of the upper-layer spacer sheet 57 It should be noted that the diameter of each through hole 32 in each lower-layer spacer sheet 58 is formed to be greater than or equal to the diameter of each through hole 32 in the upper-layer spacer sheet 57. It goes without saying that if the diameter of each through hole 32 in each spacer sheet 58 becomes large, the space concerning the venting of air can be made large, and the feeling of a click at the time of the switching operation improves.

The aforementioned FPC 54 is a circuit member including a plurality of circuits 35 routed in desired patterns, and the two air vents 36 communicating with the air release portions 33 in the respective layers of the spacer sheet 53 are formed in its central portion. The plurality of contacts 37 are disposed on the spacer sheet 53 side of the FPC 54. The plurality of chip components 38 are mounted on the adhesive sheet 55 side (the side opposite to the contact 37 side) of the FPC 54. Incidentally, the circuit member is not confined to the FPC (FPC 54).

The adhesive sheet 55 is formed so as to be able to bond and fix the FPC 54. The adhesive sheet 55 is formed so as to be bonded and fixed to the plate 56. Namely, the adhesive sheet 55 has on one side a circuit attaching surface for the FPC 54 and on its other side a bonding and fixing surface for the plate 56. The adhesive sheet 55 functions as a reinforcing member. The two air vents 39 communicating with the air vents 36 in the FPC 54 and similar thereto, as well as an accommodating portion 59 (corresponding to the adhesive sheet-side accommodating portion stated in the claims) constituting the aforementioned chip-component accommodating structure, are formed in the adhesive sheet 55.

The plate 56 includes an attaching surface 60 to which the bonding and fixing surface of the adhesive sheet 55 adheres. The two space portions 41 having, for example, U-shaped cross sections and a recessed portion 61 constituting the aforementioned chip-component accommodating structure are arranged and formed in the attaching surface 60. The recessed portion 61 is formed in correspondence with the mounting position of the chip components 38. The recessed portion 61 is formed so as to be able to accommodate the tips of the chip portions 38. It should be noted that the plate 56 in terms of its shape may be formed in the shape of a housing like a switch casing.

In the above-described construction, the poly-dome switch 51 is assembled as follows: First, the upper-layer spacer sheet 57 and the lower-layer spacer sheets 58 are bonded and fixed together to form the spacer sheet 53. Next, the surface sheet 52 is bonded and fixed to the surface (actually, the upper-layer-spacer sheet 57) of the spacer sheet 53, and the FPC 54 is bonded and fixed to the revere surface (actually, the lowermost lower-layer spacer sheet 58) of the spacer sheet 53. Subsequently, the FPC 54 side of this subassembly is bonded and fixed to the circuit attaching surface of the adhesive sheet 55, so that the plurality of chip components 38 mounted on the adhesive sheet 55 side (the side opposite to the contact 37 side) of the FPC 54 are accommodated in the accommodating portion 59 of the adhesive sheet 55 and the recessed portion 61 of the plate 56 (see FIG. 4), thereby completing the assembly. It should be noted that the assembled poly-dome switch 51 is mounted by causing the bonding and fixing surface of the adhesive sheet 55 to adhere to the attaching surface 60 of the plate 56.

As described above, the poly-dome switch 51 in accordance with the second embodiment has the chip-component accommodating structure which allows the plurality of chip components 38 mounted on the adhesive sheet 55 side (the side opposite to the contact 37 side) of the FPC 54 to be accommodated in the accommodating portion 59 of the adhesive sheet 55 and the recessed portion 61 of the plate 56. Consequently, even if the chip components 38 are mounted on the FPC 54, the adhesive sheet 55 is prevented from becoming lifted off the FPC 54 and deformed. Accordingly, even if the chip components 38 are mounted on the FPC 54, the switching function is not affected.

Third Embodiment

Figure 5:
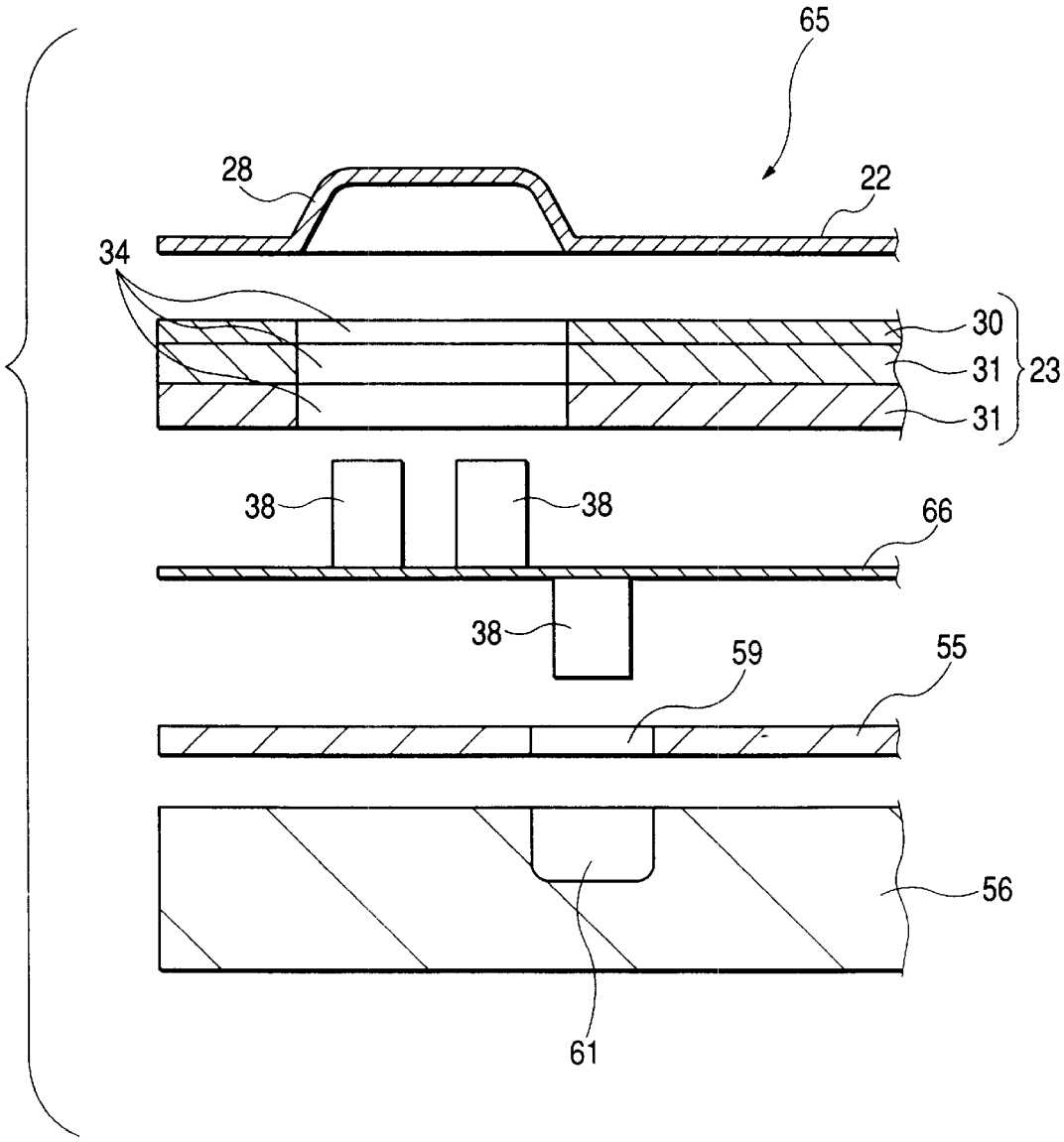
FIG. 5 is an exploded perspective view illustrating a third embodiment of the chip-component accommodating structure in a dome switch in accordance with the invention.

Next, referring to FIG. 5, a description will be given of the chip-component accommodating structure in a dome switch in accordance with a third embodiment. FIG. 5 is an exploded cross-sectional view illustrating the third embodiment of the chip-component accommodating structure in a dome switch. It should be noted that portions which are basically identical to the portions of the above-described component members will be denoted by the same reference numerals, and a description thereof will be omitted.

In FIG. 3, a poly-dome switch 65 (corresponding to the dome switch stated in the claims) is constituted by the surface sheet 22 having the embossed portion 28, the spacer sheet 23 (consisting of the upper-layer spacer sheet 30 and the lower-layer spacer sheets 31) having the accommodating portions 34, an FPC 66 serving as a circuit member with the chip components mounted on both sides, and the adhesive sheet 55 having the accommodating portion 59. The poly-dome switch 65 is fixed to the plate 56 having a recessed portion 61 by the adhesive sheet 55. In the third embodiment of the invention, the chip-component accommodating structure is formed in the surface sheet 22, the spacer sheet 23, the adhesive sheet 55, and the plate 56. It should be noted that the circuit member is not limited to the FPC (FPC 66).

As described above, the poly-dome switch 65 in accordance with the third embodiment has the chip-component accommodating structure which allows the plurality of chip components 38 mounted on the spacer sheet 23 side of the FPC 66 to be accommodated in the accommodating portions 34 of the upper-layer spacer sheet 30 and the lower-layer spacer sheets 31 and the embossed portion 28 of the surface sheet 22. The poly-dome switch 65 in accordance with the third embodiment has the chip-component accommodating structure which allows the chip components 38 mounted on the adhesive sheet 55 side of the FPC 66 to be accommodated in the accommodating portion 59 of the adhesive sheet 55 and the recessed portion 61 of the plate 56. Consequently, even if the chip components 38 are mounted on the FPC 66, the spacer sheet 23 is prevented from becoming lifted off the FPC 66 and deformed. Furthermore, even if the chip components 38 are mounted on the FPC 66, the adhesive sheet 55 is prevented from becoming lifted off the FPC 66 and deformed. Accordingly, even if the chip components 38 are mounted on the FPC 66, the switching function is not affected.

Figure 8:
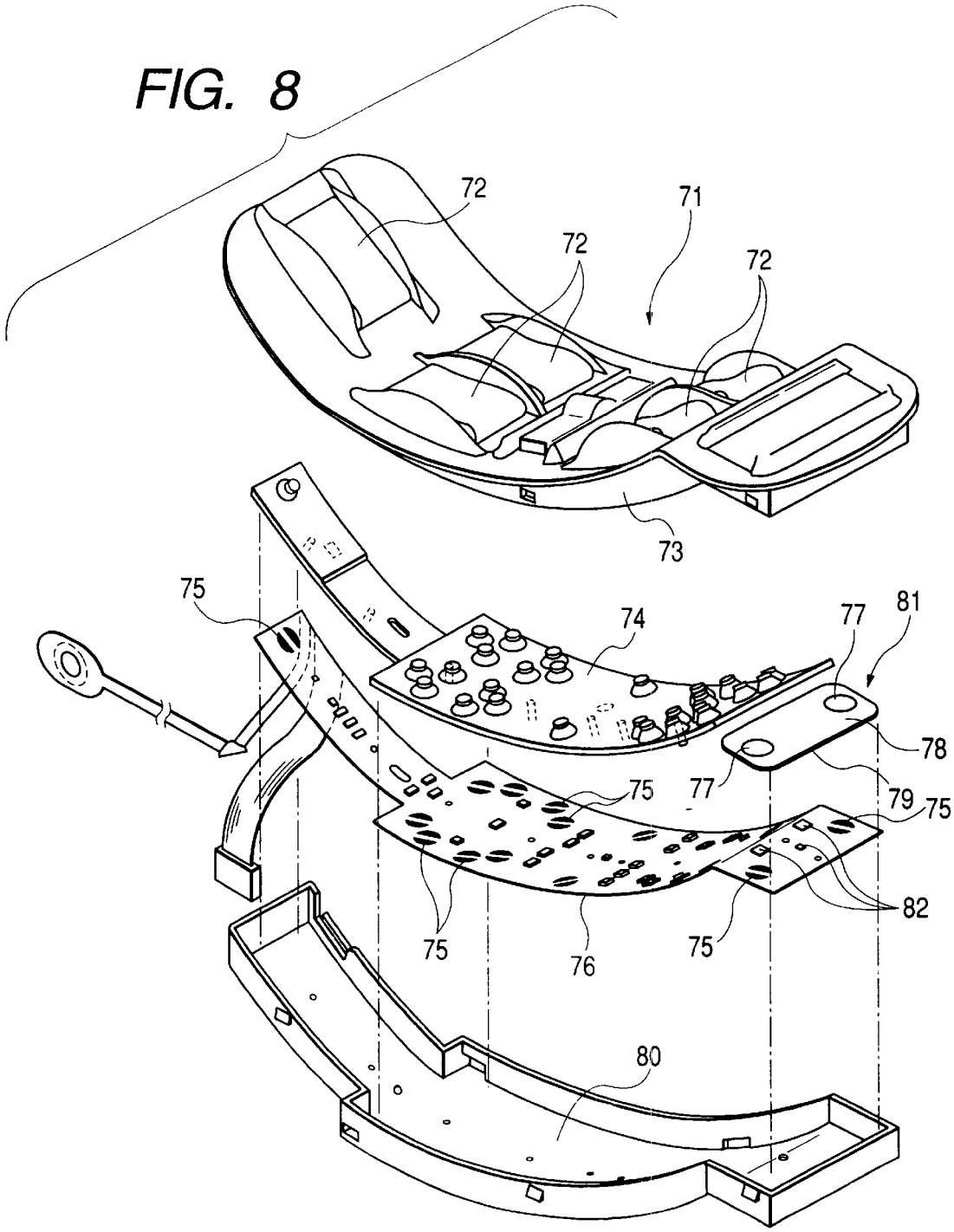
FIG. 8 is an exploded perspective view illustrating a specific example of mounting the dome switch.

Next, referring to FIG. 8, a description will be given of a specific example of mounting the dome switch. FIG. 8 is an exploded perspective view illustrating the specific example of mounting the dome switch.

In FIG. 8, reference numeral 71 denotes a switch unit for a vehicle Such as an automobile having a plurality of knob switches and a poly-dome switch. The switch unit 71 includes a bezel 73 having a plurality of switch knobs 72, a rubber contact 74, an FPC 76 serving as a circuit member having a plurality of contacts 75, a surface sheet 78 having dome-shaped protuberances 77, a spacer sheet 79 for adhering to the surface sheet 78, and an undercasing 80 which is engaged by the bezel 73. It should be noted that, in the above-described switch unit 71, a poly-dome switch 81 (corresponding to the dome switch in the claims) is made up by the surface sheet 78, the spacer sheet 79, and a portion of the FPC 76. (It is assumed that the poly-dome switch 81 has the aforementioned chip-component accommodating structure. The component designated; by reference numeral 82 corresponds to the chip component. The undercasing 80 corresponds to the attaching member stated in the claims.) Although the poly-dome switch 81 take up some switches of the switch unit 71, it goes without saying that the entire unit may be formed by a poly-dome switch such as the aforementioned poly-dome switch 81.

In addition, it goes without saying that in the invention various modifications are possible within the scope which does not depart from the gist of the invention. Namely, although in the first and third embodiments the embossed portion 28 is formed in the surface sheet 22, it goes without saying that the embossed portion 28 may be omitted in a case where the height of the chip components 38 is low. In addition, although in the second and third embodiments the recessed portion 61 is formed in the plate 56, it goes without saying that the recessed portion 61 may be omitted in a case where the height of the chip components 38 is low.

It should be understood that the poly-dome switch (dome switch) is applicable not only to the above-described switch unit for a vehicle such as an automobile or switches of equipment mounted in a vehicle. Namely, the present invention is naturally also applicable to switches for use in household electric products, switches of manufacturing apparatuses, and so forth. In addition, the numbers of the protuberances and the chip components are not limited to the above-mentioned numbers.

Fourth Embodiment

Figure 6:
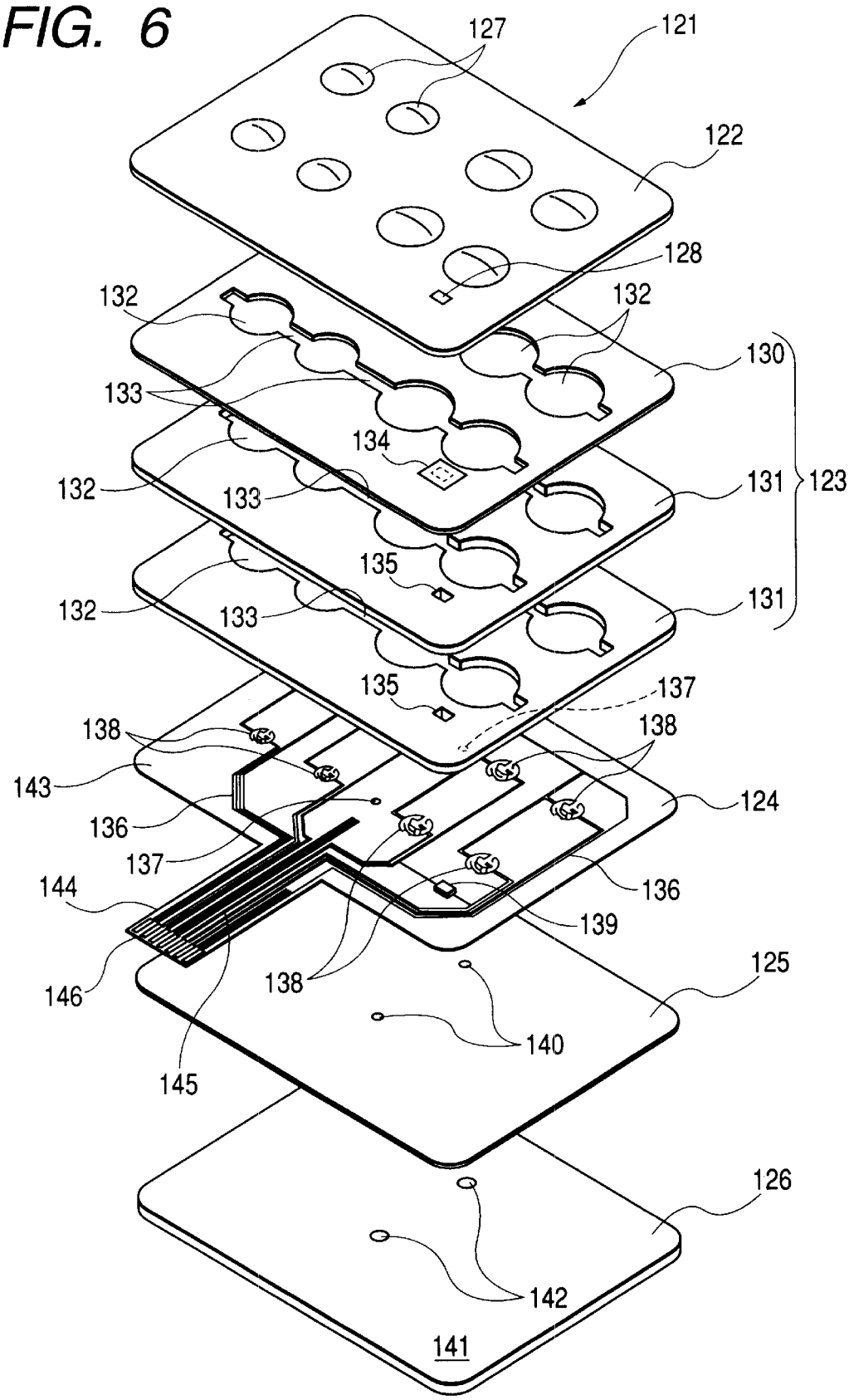
FIG. 6 is an exploded perspective view illustrating a fourth embodiment of a dome switch in accordance with the invention.
Figure 7:
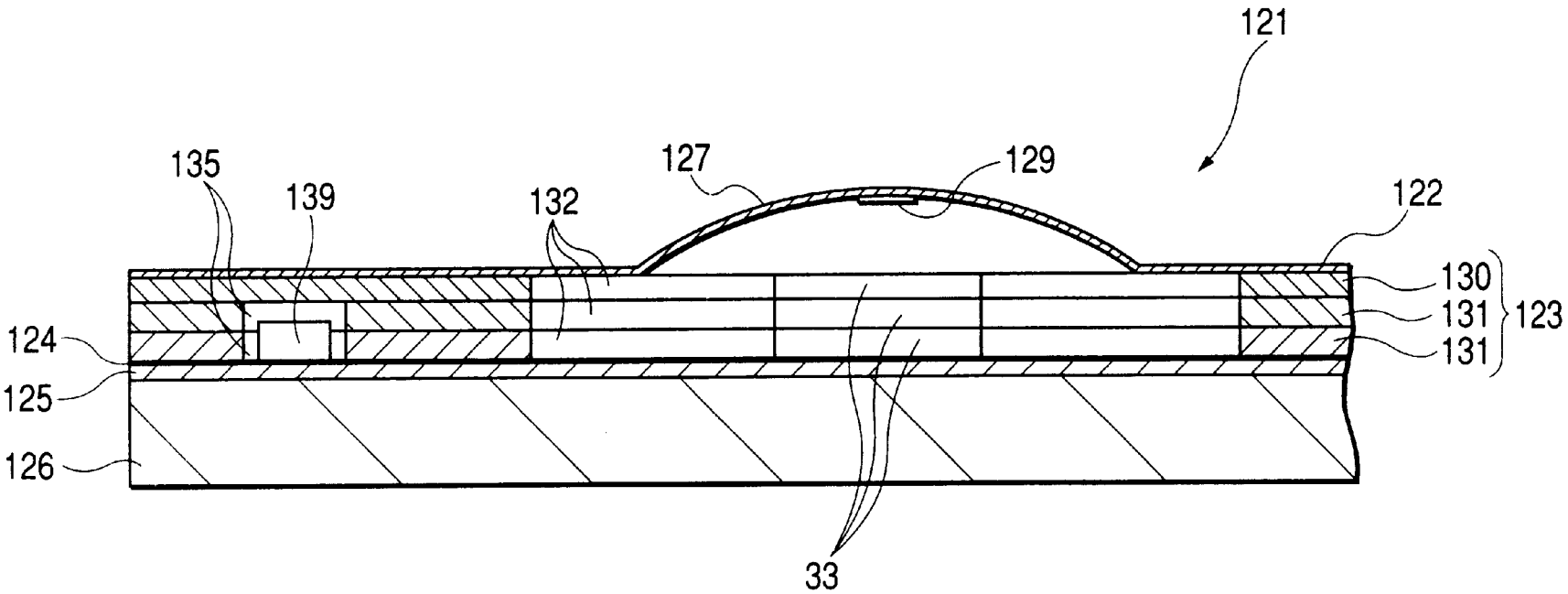
FIG. 7 is an enlarged cross-sectional view of an LED mounting portion shown in FIG. 6.

FIG. 6 is an exploded perspective view illustrating a first embodiment of a dome switch in accordance with the invention. FIG. 7 is an enlarged cross-sectional view of an LED mounting portion shown in FIG. 6.

In FIG. 6, a poly-dome switch 221 (corresponding to the dome switch in the claims) is constituted by a surface sheet 222, a spacer sheet 223, a flexible printed circuit (FPC) 224, and an adhesive sheet 225. The poly-dome switch 221 is fixed to a plate 226 serving as an example of an attaching member to be attached to by the adhesive sheet 225. In the first embodiment of the invention, the chip-component accommodating structure is formed in the surface sheet 222 and the spacer sheet 223.

The surface sheet 222 has a plurality of protuberances 227 and a light emitting portion 128 which is illuminated by the light from a light emitting diode (LED) 239 which will be described later and where the light passes. Each protuberance 227 is formed in a dome shape in which it projects toward the outer surface side and is capable of being reversed toward the inner surface side. An electrode 229 (see FIG. 7) for the FPC 224 is provided on the inner surface of each protuberance 227. The electrode 229 is provided on a top portion of the inner surface. The light emitting portion 228 is formed in correspondence with the mounting position of the LED 239 which will be described later.

The surface sheet 222 will be described in detail. The surface sheet 222 is a synthetic resin-made sheet formed of polyethylene terephthalate (PET), for example, and includes the plurality of dome-shaped protuberances 227 formed by being subjected to heat pressing (by applying pressure from the inner surface side toward the outer surface side). The electrodes 229 provided on top portions of the inner surfaces of the protuberances 227 are formed of carbon or the like (the electrodes 229 formed of carbon are provided by printing).

The spacer sheet 223 is constituted by an upper-layer spacer sheet 230 and two lower-layer spacer sheets 231. Namely, the spacer sheet 223 is constituted by three layers (the spacer sheet 223 need not necessarily be formed in three layers, and may be formed in a single layer, two layers, or four or more layers; if the spacer sheet 223 is formed in a plurality of layers, there is an advantage that the spacer sheet can be provided with more flexibility than in the case of a single layer). The spacer sheet 223 is adapted to function as a member for preventing the deformation of the surface sheet 222.

The upper-layer spacer sheet 230 is a synthetic resin-made sheet formed of polyethylene terephthalate (PET), for example, and the upper-layer spacer sheet 230 is formed to be thinner than the lower-layer spacer sheets 231. Namely, the upper-layer spacer sheet 230 functions as a fine-adjustment sheet member for adjusting the thickness of the spacer sheet 223. In addition, the upper-layer spacer sheet 230 has layers of an unillustrated adhesive agent on its obverse and reverse surfaces, so that the surface sheet 222 and the lower-layer spacer sheet 231 can be fixed to its obverse and reverse surfaces, respectively.

The upper-layer spacer sheet 230 will be described in detail. The upper-layer spacer sheet 230 includes a plurality of through holes 232, a plurality of air release portions 233, and the light diffusing member 234 for diffusing the light emitted from the LED 239 (described later). Each of the through holes 232 is a portion for ensuring contact between the electrode 229 of the protuberance 227 and a contact 237 (which will be described later) of the FPC 224, and is formed in conformity with the position of the corresponding protuberance 227. Each of the through holes 232 is formed to have a diameter greater than or equal to the diameter of the protuberance 227 (see FIG. 7).

Each of the air release portions 233 is a portion which allows the air located on the inner surface side to be released appropriately when each protuberance 227 is reversed. The air release portions 233 are formed between adjacent ones of the through holes 232 arranged in the longitudinal direction in the upper-layer spacer sheet 230. Each of the air release portions 233 is formed in the shape of a slit in such a manner as to communicate with the corresponding through holes 232.

The light diffusing member 234 is formed in a rectangular shape in correspondence with the mounting position of the LED 239 which will be described later. The light diffusing member 234 is formed in such a manner as to continue to the light emitting portion 228 of the surface sheet 222. The light diffusing member 234 is formed by effecting printing in a white color, for example. Incidentally, the formation of the light diffusing member 234 is arbitrary. In a case where the light diffusing member 234 is not formed, it suffices if a portion identical to a light guiding portion 235 which will be described later is formed.

Each of the lower-layer spacer sheets 231 is a synthetic resin-made sheet formed of polyethylene terephthalate (PET), for example, and includes unillustrated adhesive layers on its obverse and reverse surfaces, so that after their lamination the upper-layer spacer sheet 230 and the FPC 224 can be fixed to the obverse and reverse surfaces, respectively. The lower-layer spacer sheets 231 includes the through holes 232 and the air release portions 233 provided in the same numbers and having the same shapes, positions and function as those of the upper-layer spacer sheet 230, and a light guiding portions 235 formed in accordance with the mounting position of the LED 239 described later Incidentally, these members will be denoted by the same reference numerals as those of the upper-layer spacer sheet 230, and a description thereof will be omitted It should be noted that the diameter of each through hole 232 in each lower-layer spacer sheet 231 is formed to be greater than or equal to the diameter of each through hole 232 in the upper-layer spacer sheet 230. It goes without saying that if the diameter of each through hole 232 in each spacer sheet 231 becomes large, the space concerning the venting of air can be made large, and the feeling of a click at the time of the switching operation improves.

The light guiding portions 235 in the respective layers are formed so as to be able to accommodate the LED 239 (which will be described later) at the time of assembly, and so as to be able to guide the light from the LED 239 to the light emitting portion 228 of the surface sheet 222 (or the light diffusing member 234) after the assembly. In addition, the light guiding portions 235 are formed in the shape of through holes of a rectangular shape (however, their shape is not limited to the same).

The FPC 224 (corresponding to the circuit member in the claims) comprises a circuit member body 243 including a plurality of circuits 236 routed in desired patterns and an external connection member 244 used for electrical connection to external circuits.

The plurality of contacts 238 with which the electrodes 229 (see FIG. 7) are brought into contact are disposed on the spacer sheet 223 side of the circuit member body 243. In addition, two air vents 237 communicating with the air release portions 233 in the respective layers of the spacer sheet 223 are formed in the center of the circuit member body 243. The LED 239 is mounted on the spacer sheet 223 side (contact 238 side of the FPC 224) of the circuit member body 243. Incidentally, the circuit member is not confined to the FPC (FPC 224).

The external connection member 244 comprises a connection circuit portion 245 formed so as to be led out from the circuit member body 243, and a plurality of edge connector terminals 246 provided at a tip portion of the connection circuit portion 245. The connection circuit portion 245 has an appropriate length, and the circuits 236 led out from the circuit member body 243 are routed in it. In addition, the circuits 236 led out from the circuit member body 243 are respectively connected to the corresponding edge connector terminals 246.

The adhesive sheet 225 is formed so as to be able to bond and fix the FPC 224. The adhesive sheet 225 is formed so as to be bonded and fixed to the plate 226. Namely, the adhesive sheet 225 includes on one side a circuit attaching surface for the FPC 224 and on its other side a bonding and fixing surface for the plate 226. The adhesive sheet 225 functions as a reinforcing member. Two air vents 240 communicating with the air vents 237 in the FPC 224 and similar thereto are formed in the adhesive sheet 225.

The plate 226 includes an attaching surface 241 to which the bonding and fixing surface of the adhesive sheet 225 adheres. Two space portions 242 having, for example, U-shaped cross sections are arranged and formed in the attaching surface 241. The space portions 242 are communicated with the air release portions 233 in the spacer sheet 223 through the air vents 237 in the FPC 224 and the air vents 240 in the adhesive sheet 225 (the air vents 237 in the FPC 224 and the air vents 240 in the adhesive sheet 225 function as passages for communication with the air release portions 233 in the spacer sheet 223 and the space portions 242 in the plate 226). It should be noted that the plate 226 in terms of its shape may be formed in the shape of a housing like a switch casing.

In the above-described construction, the poly-dome switch 221 is assembled as follows: First, the upper-layer spacer sheet 230 and the lower-layer spacer sheets 231 are bonded and fixed together to form the spacer sheet 223. Next, the surface sheet 222 is bonded and fixed to the surface (actually, the upper-layer spacer sheet 230) of the spacer sheet 223, and the FPC 224 is bonded and fixed to the revere surface (actually, the lowermost lower-layer spacer sheet 231) of the spacer sheet 223, so that the LED 239 mounted on the spacer sheet 223 side (contact 238 side) of the FPC 224 are accommodated in the light guiding portion 235 of the lower-layer spacer sheets 231 (see FIG. 7). Subsequently, the FPC 224 side of this subassembly is bonded and fixed to the circuit attaching surface of the adhesive sheet 225, thereby completing the assembly. It should be noted that the assembled poly-dome switch 221 is mounted by causing the bonding and fixing surface of the adhesive sheet 225 to adhere to the attaching surface 241 of the plate 226 and connecting the external connection member 244 to a predetermined connection portion.

As described above, in the poly-dome switch 221, the LED 239 is mounted on the FPC 224 in accordance with the invention. When the mounted LED 239 is made to emit light, the light from the LED 239 is guided through the light guiding portions 235 in the spacer sheet 223, and the light emitting portion 228 of the surface sheet 222 is illuminated. The light emitting portion 228 itself, as it were, emits light due to the light which passed through the light emitting portion 228. When the mounted LED 239 is made to emit light, the light from the LED 239 is diffused by the light diffusing member 234. The entire light emitting portion 228 of the surface sheet 222 is then illuminated by the diffused light. Meanwhile, in the assembly of the poly-dome switch 221, the LED 239 mounted on the FPC 224 is accommodated in the light guiding portions 235 of the spacer sheet 223. In other words, by forming the light guiding portions 235 in the spacer sheet 223, it becomes possible to mount the LED 239 on the contact 238 side of the FPC 224. Accordingly, it becomes possible to provide the poly-dome switch 221 capable of illuminating the switch.

In the invention, since the adhesive sheet 225 is provided, and the FPC 224 is provided with the external connection member 244, the poly-dome switch 221 can be easily installed at a position which meets the user's need. In the invention, since electrical connection to external circuits can be established through the edge connector terminals 246 (the same also applies to a connector 247 which will be described later), the installation of the poly-dome switch 221 is facilitated, and the range of its installation can be expanded. In the invention, since connection to external circuits can be made within the range of the length of the connection circuit portion 245, the range of installation of the poly-dome switch 221 can be further expanded.

It should be noted that although the mounting of the LED 239 makes the spacer sheet 223 thick in correspondence with the height of the LED 239, there is an advantage in that the dimension of the stroke of the protuberance 227 can be enlarged (a large stroke can be obtained for the protuberance 227).

Figure 9:
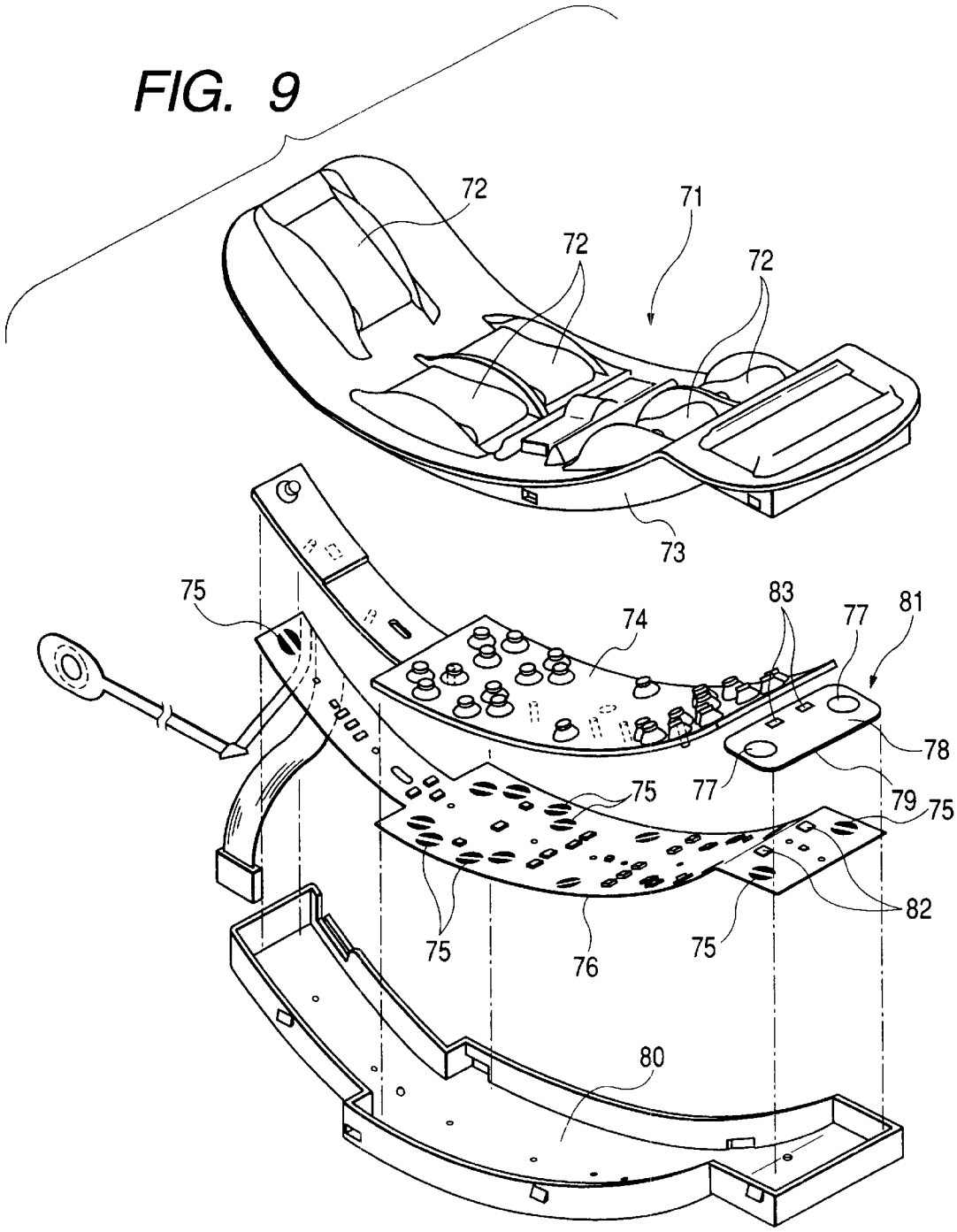
FIG. 9 is an exploded perspective view illustrating a specific example of mounting the dome switch.

Next, referring to FIG. 9, a description will be given of a specific example of mounting the dome switch. FIG. 9 is an exploded perspective view illustrating the specific example of mounting the dome switch.

In FIG. 9, reference numeral 271 denotes a switch unit for a vehicle such as an automobile having a plurality of knob switches and a poly-dome switch. The switch unit 271 includes a bezel 273 having a plurality of switch knobs 272, a rubber contact 274, an FPC 276 serving as a circuit member having a plurality of contacts 275, a surface sheet 278 having dome-shaped protuberances 277, a spacer sheet 279 for adhering to the surface sheet 278, and an undercasing 180 which is engaged by the bezel 273. It should be noted that, in the above-described switch unit 271, a poly-dome switch 281 (corresponding to the dome switch stated in the claims) is made up by the surface sheet 276, the spacer sheet 279, and a portion of the FPC 276. (It is assumed that the poly-dome switch 281 has the aforementioned chip-component accommodating structure. The component designated by reference numeral 282 corresponds to the LED. The component designated by reference numeral 283 is the light emitting portion. The undercasing 280 corresponds to the attaching member stated in the claims.) Although the poly-dome switch 281 take up some switches of the switch unit 271, it goes without saying that the entire unit may be formed by a poly-dome switch such as the aforementioned poly-dome switch 281.

Fifth Embodiment

Figure 10:
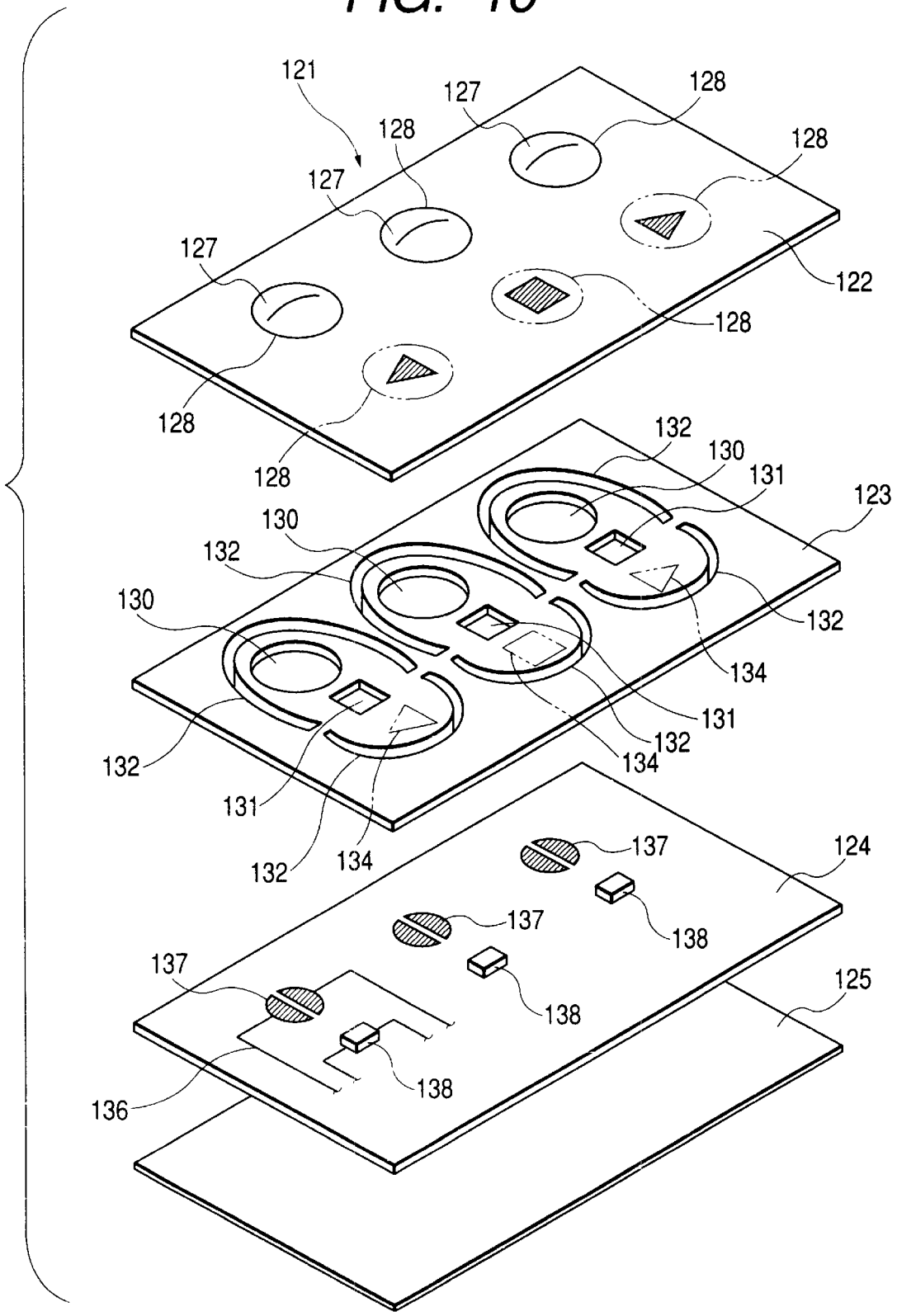
FIG. 10 is an exploded perspective view illustrating a fifth embodiment of the dome in accordance with the invention.
Figure 11:
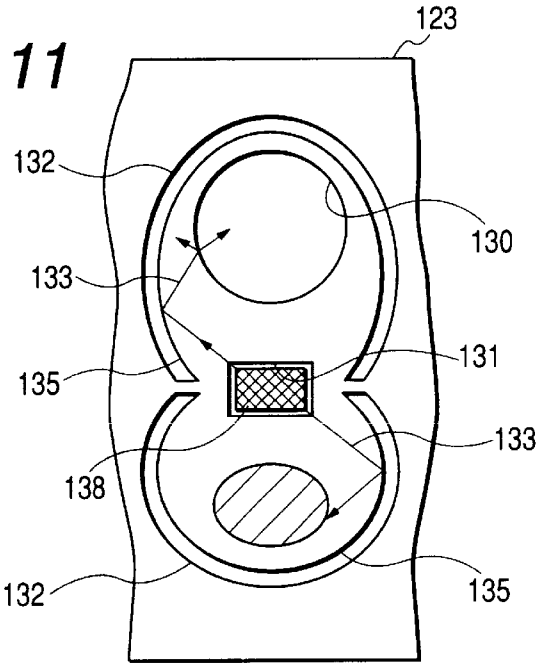
FIG. 11 is an enlarged plan view of a spacer sheet shown in FIG. 10.
Figure 12:
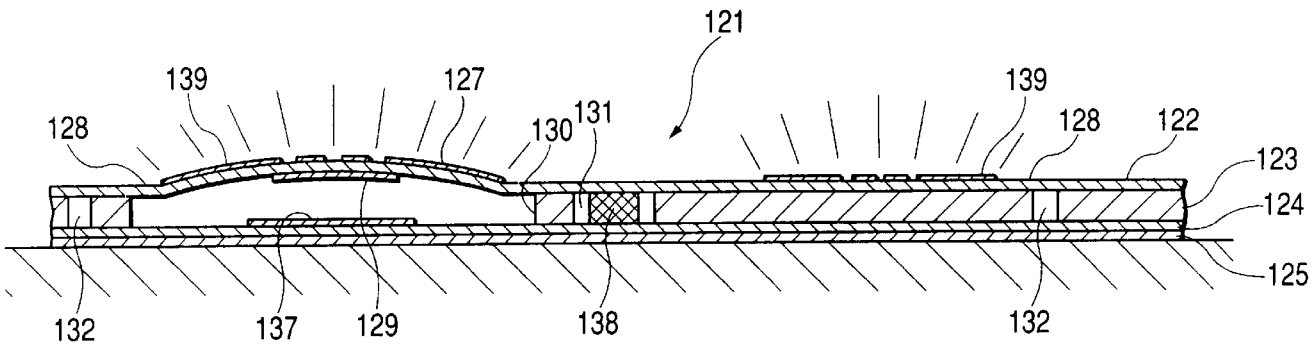
FIG. 12 is an enlarged cross-sectional view of the LED mounting portion shown in rig. 10.

Next, referring to FIGS. 10 to 12, a description will be given of a second embodiment of the dome switch. FIG. 10 is an exploded perspective view illustrating the second embodiment of the dome switch in accordance with the invention. Further, FIG. 11 is an enlarged plan view of the spacer sheet shown in FIG. 10, and FIG. 12 is an enlarged cross-sectional view of an LED mounted portion shown in FIG. 11.

In FIG. 10, a poly-dome switch 121 of the invention (corresponding to the dome switch in the claims) comprises a surface sheet 122, a spacer sheet 123, and a flexible printed circuit (FPC) 124. The poly-dome switch 121 comprises an adhesive sheet 125 required at the time of installation. In the poly-dome switch 121 of the invention having such construction, an LED 138 which will be described later is mounted on the FPC 124 in the same way as the above-described poly-dome switch 221 (see FIG. 6).

The surface sheet 122 is flexible, and is provided with a plurality of protuberances 127 and a plurality of second light emitting portions 128 which are illuminated by the light from the LEDs 138 which will be described later and where the light passes. Each of the protuberances 127 is formed in a dome shape so as to project toward outside and is capable of being reversed toward inside. An electrode 129 (see FIG. 12) for the FPC 124 is provided on the inner surface of each protuberance 127. The electrode 129 is provided on a top portion of the inner surface.

The surface sheet 122 will be described in detail. The surface sheet 122 is a synthetic resin-made sheet member formed of polyethylene terephthalate (PET), for example, and includes the protuberances 127 formed by being subjected to heat pressing (by applying pressure from the inner surface side toward the outer surface side). The electrodes 129 (see FIG. 12) provided on top portions of the inner surfaces of the protuberances 127 are formed of carbon or the like (the electrodes 129 formed of carbon are provided by printing).

Since the surface sheet 122 is formed of the aforementioned material, the surface sheet 122 is originally transparent, and in this embodiment symbols including a triangle "Δ," a square "□," and an inverse triangle "▽" are printed on its inner surface in, for instance, a solid black color (printed so as to correspond to the respective protuberances 127). A background color is also printed in, for instance, a white color on that inner surface (the electrodes 129 formed of carbon are provided after the printing). It should be noted that in this embodiment the aforementioned background color functions as the reflector in the claims. Incidentally, as a color other than the white color, it is possible to cite a silver color. The reflector suffices insofar as it is capable of reflecting the light and preventing the light from leaking from the spacer sheet 123. Apart from the above-described technique, it is possible to cite a technique in which after the printing of the background color in an appropriate manner, a reflector is provided. The reflector has the advantage of being able to guide the light efficiently.

In this embodiment, the second light emitting portions 128 are portions which are not provided with the aforementioned background color and reflector, and portions coinciding with the respective protuberances 127 and portions surrounding the aforementioned symbols correspond to the second light emitting portions 128.

In FIGS. 10 and 11, the spacer sheet 123 is a synthetic resin-made flexible transparent sheet member formed of, for example, polyethylene terephthalate (PET), and functions as a member for preventing the deformation of the surface sheet 122. The spacer sheet 123 has layers of an unillustrated adhesive agent on its obverse and reverse surfaces, so that the surface sheet 122 and the FPC 124 can be fixed to its obverse and reverse surfaces, respectively. The spacer sheet 123 includes a plurality of through holes 130, a plurality of second light guiding portions 131 formed in correspondence with the mounting positions of the LEDs 138 which will be described later, and a plurality of light collecting portions 132 formed in correspondence with the positions of the second light emitting portions 128.

The through holes 130 are respectively formed in alignment with the positions of the corresponding protuberances 127, and are.adapted to allow the reversed protuberances 127 to pass therethrough. Each of through holes 130 is formed to have a diameter greater than the diameter of the corresponding protuberance 127 (see FIG. 12). However, the diameter of each through hole 130 may be identical to that of the protuberance 127.

Each of the second light guiding portions 131 is formed so as to be able to accommodate the LED 138 (which will be described later) at the time of assembly, and so as to be able to guide the light from the LED 138 (see an optical path 133) into the spacer sheet 123 after the assembly. The second light guiding portions 131 are formed in the shape of through holes of a rectangular shape (however, their shape is not limited to the same).

In this embodiment, the light collecting portions 132 are formed as substantially U-shaped slits which, for example, partially surround the through hole 130 (the portion corresponding to one second light emitting portion 12B) and a portion 134 corresponding to the symbol (the portion corresponding to another second light emitting portion), respectively. The light collecting portions 132 are so arranged that their inner side surfaces 135 are able to reflect the guided light (see the optical path 133) and collect it to the respective portions mentioned above.

In FIG. 10, the FPC 124 (corresponding to the circuit member stated in the claims) includes a plurality of circuits 136 routed in desired patterns. A plurality of contacts 137 which are contacted by the electrodes 129 (see FIG. 12) are provided on the spacer sheet 123 side of the FPC 124. The LEDs 138 are mounted on the spacer sheet 123 side (contact 137 side) of the FPC 124. The reflector similar to the one described above is provided over a substantially entire surface of the spacer sheet 123 side (contact 137 side) of the FPC 124.

It should be noted that the circuit member is not limited to the FPC (FPC 124). The above-described external connection member 44 (see FIG. 6) may be provided. The reflector may be provided not only on the surface sheet 122 and the FPC 124 but also on the obverse and reverse surfaces of the spacer sheet 123.

The adhesive sheet 125 is formed so as to allow the FPC 124 to be bonded and fixed thereto. Namely, the adhesive sheet 125 has on one side a circuit attaching surface with respect to the FPC 124. Meanwhile, the adhesive sheet 125 has on its other side a bonding and fixing surface with respect to, for instance, the plate 226 (see FIG. 6) serving as an attaching member. Unillustrated release paper is provided on the bonding and fixing surface of the adhesive sheet 125. The unillustrated release paper is provided to protect the bonding and fixing surface up until the time of final use and to permit the carrying of the poly-dome switch 121.

It should be noted that the adhesive sheet 125 may function as a reinforcing member within the range which does not impair the flexibility of the poly-dome switch 121. The release paper may be provided on the adhesive sheet 225.

In the above-described construction, the poly-dome switch 121 is assembled as follows: First, the surface sheet 122 is bonded and fixed to the surface of the spacer sheet 123, and the FPC 124 is bonded and fixed to the reverse surface of the spacer sheet 123, so that the LEDs 138 mounted on the spacer sheet 123 side (contact 137 side) of the FPC 124 are accommodated in the second light guiding portions 131 of the spacer sheet 123 (see FIG. 6). Next, the FPC 124 side of this subassembly is bonded and fixed to the circuit attaching surface of the adhesive sheet 125, thereby completing the assembly.

It should be noted that the assembled poly-dome switch 121 is mounted by causing the bonding and fixing surface of the adhesive sheet 125 to adhere to the attaching surface 241 (see FIG. 6) of the plate 226, for example (alternatively, the assembled poly-dome switch 121 may be applied to the above-described switch unit 271 instead of the dome switch 81 (see FIG. 9)).

As described above, in the poly-dome switch 121, the LEDs 138 are mounted on the FPC 124 in accordance with the second embodiment of the invention. When the mounted LEDs 138 are made to emit light, as shown in FIG. 12 (a design portion 139 is provided as an example on the outer side of the second light emitting portion 128), the light (see the optical path 133) from the LEDs 138 is guided through the second light guiding portions 131 and the light collecting portions 132 in the spacer sheet 123, and the second light emitting portions 128 of the surface sheet 122 are illuminated. The light emitting portions 128 themselves, as it were, emit light due to the light which passed through the second light emitting portions 128. Meanwhile, in the assembly of the poly-dome switch 121, the LEDs 138 mounted on the FPC 124 are accommodated in the second light guiding portions 131 of the spacer sheet 123. In other words, by forming the second light guiding portions 131 in the spacer sheet 123, it becomes possible to mount the LEDs 138 on the contact 137 side of the FPC 124. Accordingly, it becomes possible to provide the poly-dome switch 121 capable of illuminating the switch.

Modification

Figure 13:
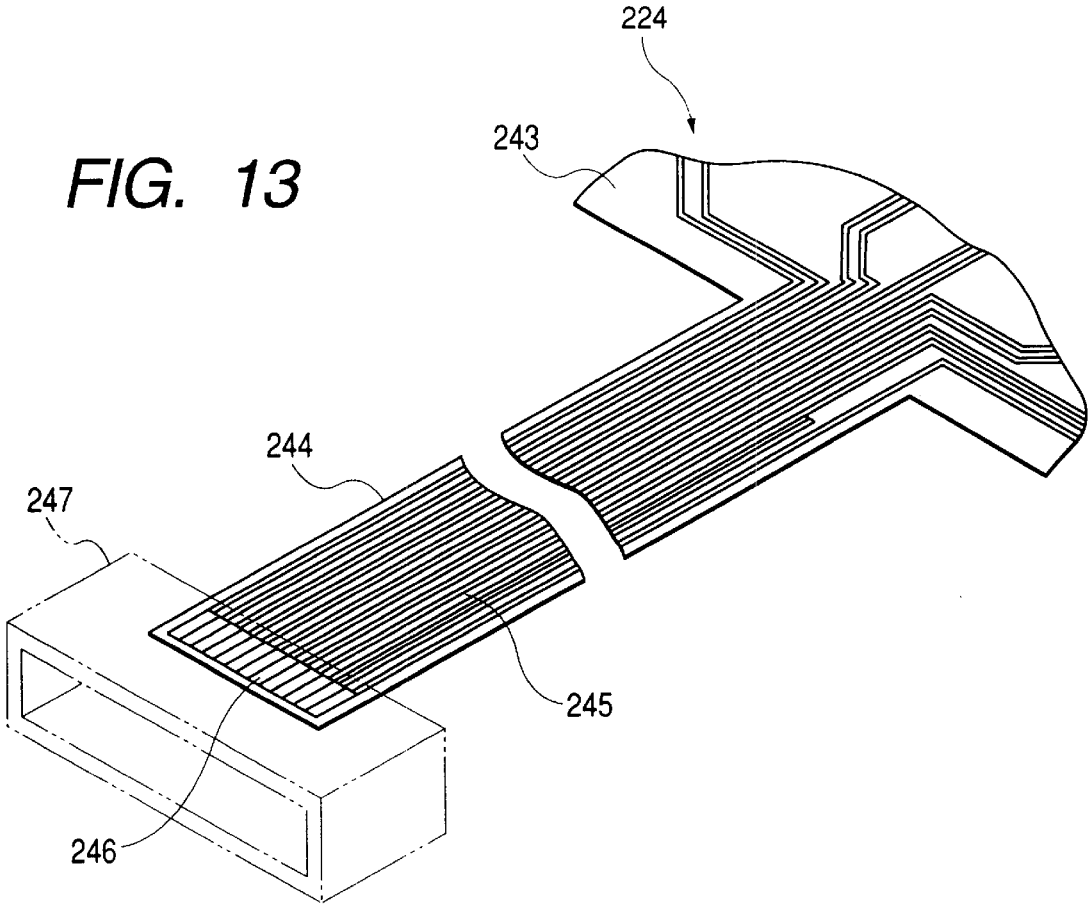
FIG. 13 is a perspective view for explaining another example of an external connection member.

Next, a description will be given of a modification based on the above-described poly-dome switch 221 in the fourth embodiment (the same also applies to the poly-dome switches 281 and 121 in the case where the external connection member 244 is provided). FIG. 13 is a perspective view for explaining another example of the external connection member 244. In addition, FIG. 14 is a cross-sectional view for explaining still another example of the external connection member 244.

In FIG. 13, the plurality of edge connector terminals 246 are provided in the external connection member 244 (see FIG. 6), but an arrangement is provided such that, instead of the plurality of edge connector terminals 246, a connector 247 indicated by the phantom lines can be provided at the tip portion of the connection circuit portion 45, as shown in FIG. 13. Thus, it should be understood that the arrangement of the external connection member 244 can be modified, as required, in conformity with the form of the mating member for connection.

Figure 14:
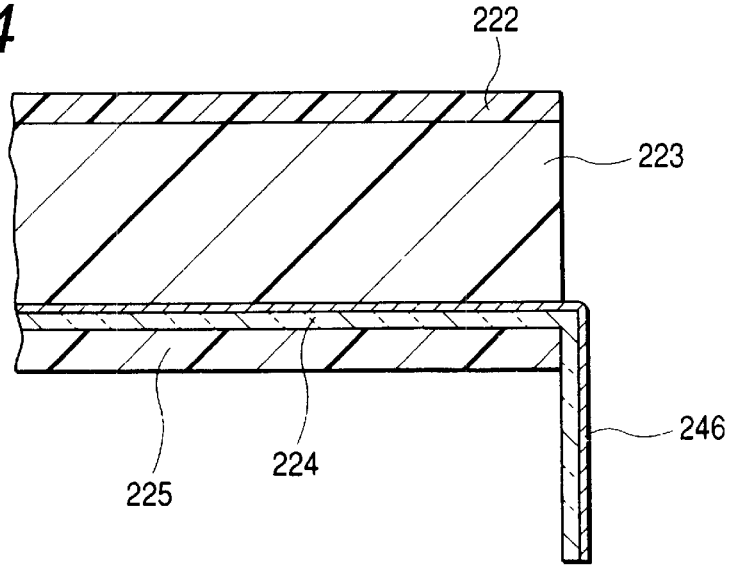
FIG. 14 is a perspective view for explaining another example of the external connection member.
Figure 15:
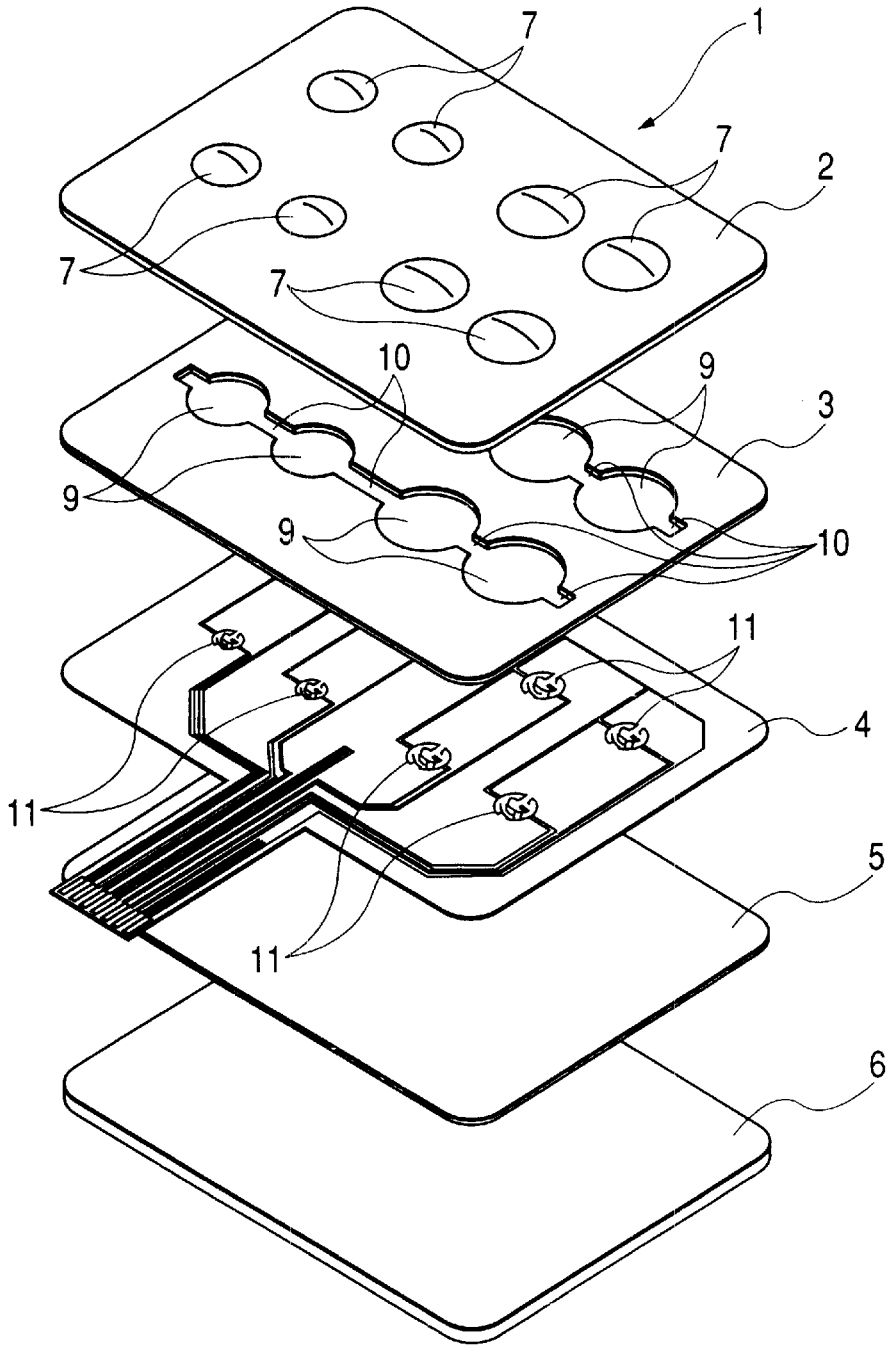
FIG. 15 is an exploded perspective view of a poly-dome switch (dome switch) in a related art.
Figure 16:
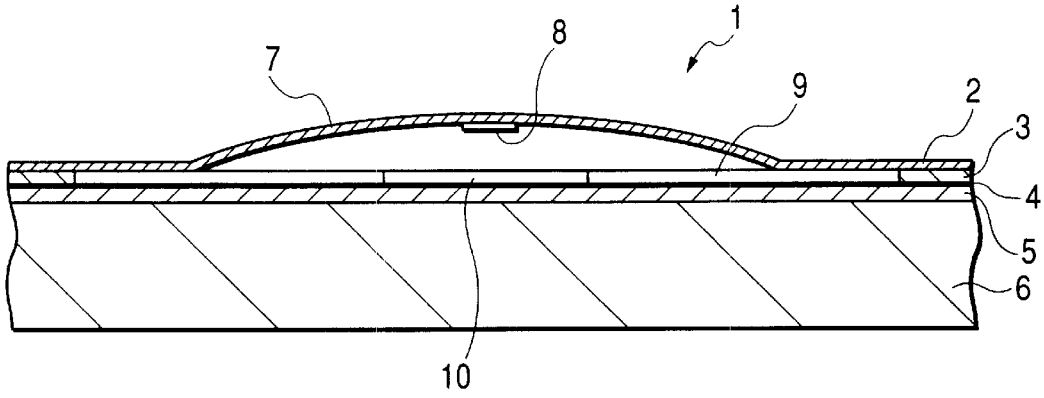
FIG. 16 is a cross-sectional view of essential portions before the switching operation in FIG. 15.
Figure 17:
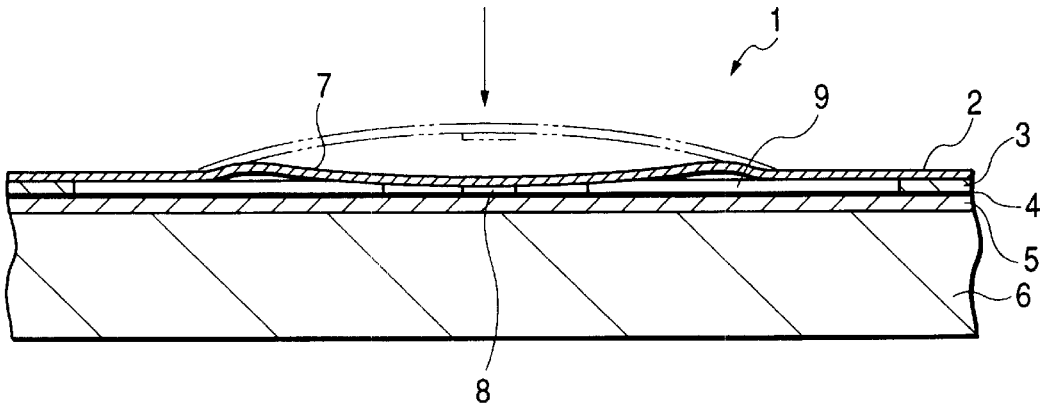
PRIOR ART FIG. 17
FIG. 17 is a cross-sectional view of the essential portions at the time of the switching operation in FIG. 15.

The external connection member 244 (see FIG. 6) is provided with the connection circuit portion 245 having an appropriate length, but the external connection member 244 may be constituted by only the plurality of edge connector terminals 246, as shown in FIG. 14. The plurality of edge connector terminals 246 may be provided in such a manner as to be bent perpendicularly to the circuit member body 243 or provided in such a manner as to be bent to extend along the bonding and fixing surface of the adhesive sheet 225. Therefore, it should be understood that the arrangement of the external connection member 244 can be modified, as required, in conformity with the mating member for connection.

It goes without saying that in the invention various modifications are possible within the scope which does not depart from the gist of the invention. Namely, the numbers of the protuberances and the LEDs are not limited to the above-mentioned numbers.

It should be understood that the poly-dome switch (dome switch) is applicable not only to the above-described switch unit for a vehicle such as an automobile or switches of equipment mounted in a vehicle. Namely, the present invention is naturally also applicable to switches for use in household electric products, switches of manufacturing apparatuses, and so forth.

As described above, in accordance with the invention, since the spacer sheet-side accommodating portion is formed in the spacer sheet, in the assembly of the dome switch, the chip component mounted on the contact side of the circuit member can be accommodated in the spacer sheet-side accommodating portion. Accordingly, it becomes possible to provide a chip-component accommodating structure in a dome switch which makes it possible to mount a chip component on a circuit member.

In accordance with the invention, since the adhesive sheet-side accommodating portion is formed in the adhesive sheet, in the assembly of the dome switch, the chip component mounted on the side of the circuit member opposite to the side where the contact is formed can be accommodated in the adhesive sheet-side accommodating portion. Accordingly, it becomes possible to provide a chip-component accommodating structure in a dome switch which makes it possible to mount a chip component on a circuit member.

In accordance with the invention, since the spacer sheet-side accommodating portion is formed in the spacer sheet, in the assembly of the dome switch, the chip component mounted on the contact side of the circuit member can be accommodated in the spacer sheet-side accommodating portion. In addition, since the adhesive sheet-side accommodating portion is formed in the adhesive sheet, in the assembly of the dome switch, the chip component mounted on the side of the circuit member opposite to the side where the contact is formed can be accommodated in the adhesive sheet-side accommodating portion. Accordingly, it becomes possible to provide a chip-component accommodating structure in a dome switch which makes it possible to mount a chip component on a circuit member In accordance with the invention, since the embossed portion is formed in the surface sheet, it becomes possible to mount the chip component with large height on the contact side of the circuit member.

In accordance with the invention, since the recessed portion is formed in the attaching member, it becomes possible to mount the chip component with large height on the side of the circuit member opposite to the side where the contact is disposed.

Further in accordance with the invention, since the light guiding portion for accommodation and light guidance for the LED is formed in the spacer sheet, the LED can be mounted on the circuit member. In addition, if the LED is made to emit light, the light guided by the light guiding portion of the spacer sheet illuminates the light emitting portion of the surface sheet, so that the light emitting portion itself is made to appear to, as it were, emit the light due to the light which passed through the light emitting portion. Accordingly, an advantage is offered in that it is possible to provide a dome switch capable of illuminating the switch.

In accordance with the invention, since the diffusing means is formed in the light guiding portion of the spacer sheet, it is possible to guide the diffused light toward the light emitting portion of the surface sheet. Accordingly, an advantage is offered in that the overall portion to be illuminated can be reliably illuminated.

In accordance with the invention, since the second light guiding portion for accommodation and light guidance for the LED is formed in the spacer sheet, the LED can be mounted on the circuit member. In addition, if the LED is made to emit light, the light guided by the second light guiding portion and the light guiding portion of the spacer sheet illuminates the second light emitting portion of the surface sheet, so that the second light emitting portion itself is made to appear to, as it were, emit the light due to the light which passed through the second light emitting portion. Accordingly, an advantage is offered in that it is possible to provide a dome switch capable of illuminating the switch.

In accordance with the invention, the light can be efficiently guided between the second light guiding portion and the light collecting portion by the reflector. Accordingly, an advantage is offered in that the second light emitting portion can be made to emit light sufficiently.

In accordance with the invention, since the adhesive sheet is further provided in the arrangement, and since the circuit member has the external connection member, an advantage is offered in that the dome switch can be installed at a position which meets the user's need (the range of installation can be further expanded). In addition, there is another advantage in that the dome switch can be easily attached (the installation can be facilitated).

In accordance with the invention, electrical connection to an external circuit can be effected by the edge connector terminals or the connector. Accordingly, in addition to the advantages of the invention according to claim 5, an advantage is offered in that the installation is further facilitated.

In accordance with the invention, electrical connection to an external circuit can be made within the range of the length of the connection circuit portion led out from the circuit member body. Accordingly, in addition to the advantages of the invention according to claim 6, an advantage is offered in that the range of installation can be further expanded.

In accordance with the invention, an advantage is offered in that the protection of the bonding and fixing surface and the carrying of the switch are made possible.

What is claimed is:

1. A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

an adhesive sheet including on one side a circuit attaching surface for the circuit member and on the other side a bonding and fixing surface for an attaching member; and a spacer sheet-side accommodating portion, for accommodating a chip component mounted on a side of the circuit member where the contact is disposed, formed in the spacer sheet.

2. The dome switch according to claim 1, wherein an embossed portion for the chip component is formed in the surface sheet in correspondence with a position of the pacer sheet-side accommodating portion.

3. A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

an adhesive sheet including on one side a circuit attaching surface for the circuit member and on the other side a bonding and fixing surface for an attaching member; and an adhesive sheet-side accommodating portion, for accommodating a chip component mounted on a side of the circuit member where the contact is not disposed, formed in the adhesive sheet.

4. The dome switch according to claim 3, wherein a recessed portion for the chip component is formed in the attaching member in correspondence with a position of said adhesive sheet-side accommodating portion.

5. A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

an adhesive sheet including on one side a circuit attaching surface for the circuit member and on the other side a bonding and fixing surface for an attaching member;

a spacer sheet-side accommodating portion, for accommodating a chip component mounted on a side of the circuit member where the contact is disposed, is formed in the spacer sheet; and an adhesive sheet-side accommodating portion, for accommodating a chip component mounted on a side of the circuit member opposite to the side where the contact is disposed, is formed in the adhesive sheet.

6. The dome switch according to claim 5, wherein an embossed portion for the chip component is formed in the surface sheet in correspondence with a position of the spacer sheet-side accommodating portion.

7. The dome switch according to claim 5, wherein a recessed portion for the chip component is formed in the attaching member in correspondence with a position of the adhesive sheet-side accommodating portion.

8. A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member and includes,a through hole formed therein for ensuring contact between the electrode and the contact point;

a light guiding portion, for accommodating and light guidance for a LED mounted on a side of the circuit member where the contact is disposed, formed in the spacer sheet; and a light emitting portion, which is illuminated by light from the LED and through which the light can pass, formed in the surface sheet.

9. The dome switch according to claim 8, wherein a light diffusing member for diffusing the light from the LED toward the light emitting portion is formed between the light guiding portion and the light emitting portion.

10. The dome switch according to claim 8, further comprising:

an adhesive sheet having on one side a circuit attaching surface for the circuit member and on the other side a bonding and fixing surface for an attaching member; and an external connection member provided on the circuit member so as to be used for electrical connection to an external circuit.

11. The dome switch according to claim 10, wherein the external connection member includes edge connector terminals or a connector.

12. The dome switch according to claim 11, wherein the external connection member includes a connection circuit portion led out from a circuit member body.

13. The dome switch according to claim 10, wherein the adhesive sheet includes a release paper on the bonding and fixing surface.

14. A dome switch comprising:

a front sheet;

a dome-shaped protuberance which is formed on the front sheet so as to protrude outside, can be reversed inside and includes an electrode provided therein;

a circuit member having a contact point with which the electrode are brought into contact when the protuberance is reversed;

a spacer sheet which is interposed between the front sheet and the circuit member, and includes a through hole formed therein for ensuring contact between the electrode and the contact point;

a light guiding portion, for accommodating and light guidance for a LED mounted on a side of the circuit member where the contact is disposed, formed in the spacer sheet;

a light collecting portion, for collecting the light guided by the light guiding portion, formed in the spacer sheet; and a light emitting portion, which is illuminated by collected light from the light collecting portion and through which the light can pass, formed in the surface sheet.

15. The dome switch according to claim 14, wherein a reflector is provided on obverse and reverse surfaces of the spacer sheet or on the inner surface of the surface sheet and the side of the circuit member where the contact is disposed.

16. The dome switch according to claim 14, further comprising:

an adhesive sheet having on one side a circuit attaching surface for the circuit member and on the other side a bonding and fixing surface for an attaching member; and an external connection member provided on the circuit member so as to be used for electrical connection to an external circuit.

17. The dome switch according to claim 16, wherein the external connection member includes edge connector terminals or a connector.

18. The dome switch according to claim 17, wherein the external connection member includes a connection circuit portion led out from a circuit member body.

19. The dome switch according to claim 16, wherein the adhesive sheet includes a release paper on the bonding and fixing surface.

* * * * *